US005303866A

United States Patent [19]

Hawks, Jr.

[11] Patent Number: 5,303,866

[45] Date of Patent: Apr. 19, 1994

[54] INTEGRATED MODULAR SPRAYING SYSTEM

[76] Inventor: Bill J. Hawks, Jr., 8253 Greenbriar Ct., Wichita, Kans. 67226

[21] Appl. No.: 943,858

[22] Filed: Sep. 11, 1992

[51] Int. Cl.[5] ..... B65H 75/00; B05B 9/04

[52] U.S. Cl. ..... 239/142; 239/197; 239/198; 239/127; 239/332; 242/86.2; 137/355.12; 137/355.27; 285/190

[58] Field of Search ..... 239/195, 197, 198, 302, 239/332, 337, 142, 127; 242/86.2; 137/355.12, 355.16, 355.2, 355.26, 355.27; 285/190, 281

[56] References Cited

U.S. PATENT DOCUMENTS

| | | | |
|---|---|---|---|
| 1,573,439 | 2/1926 | Bedford | 285/190 |
| 1,612,206 | 12/1926 | Nicholson | 285/190 |
| 1,992,750 | 2/1935 | Jensen | 285/190 |
| 2,334,141 | 11/1943 | Zierden | 285/190 |
| 2,547,826 | 4/1951 | Kirschner | 285/281 |
| 2,692,798 | 10/1954 | Hicks | 239/127 |
| 2,757,958 | 8/1956 | Bussey et al. | 239/127 |
| 3,088,759 | 5/1963 | Corsette | 285/190 |
| 3,878,896 | 4/1975 | White et al. | 239/198 |
| 4,277,026 | 7/1981 | Garvey | 239/127 |
| 4,291,769 | 9/1981 | Muller | 239/332 |
| 4,570,855 | 2/1986 | Johnston | 239/195 |
| 4,576,337 | 3/1986 | Post | 239/127 |
| 4,655,399 | 4/1987 | Harvey | 137/355.27 |
| 4,974,627 | 12/1990 | Nelson | 137/355.2 |
| 5,052,432 | 10/1991 | Vonalt et al. | 137/355.16 |
| 5,080,401 | 1/1992 | Stich | 285/190 |
| 5,094,480 | 3/1992 | Boileau | 285/190 |
| 5,139,751 | 8/1992 | Mansfield et al. | 137/355.2 |
| 5,179,972 | 1/1993 | Eley | 242/86.2 |

*Primary Examiner*—Andres Kashnikow
*Assistant Examiner*—Christopher G. Trainor
*Attorney, Agent, or Firm*—Lawrence E. Evans, Jr.

[57] ABSTRACT

The integrated modular spraying system is suitable for applying chemicals, including liquids and dry flowables, to various remote locations. The system includes an integrated modular tank which is preferably roto-molded from thermoplastic. A well is formed in the side of the tank and is further defined by two opposing buttresses which receive and support a freely rotating hose spool. A pump is located in a recess in the tank for pumping chemicals from the tank through the flexible hose. The hose can be peeled off from the hose spool for a substantial length to enable an operator to spray a chemical at locations remote from the integrated modular spray apparatus. After application of the chemical is complete, the hose spool can be rotated to rewind the flexible hose about the spool. In an alternative embodiment, the apparatus is suitable for applying dry flowables, including various insecticidal dusts and powders, using an air pump instead of a liquid pump.

31 Claims, 17 Drawing Sheets

INTEGRATED MODULAR SPRAYING SYSTEM

BACKGROUND OF THE INVENTION

A. Field of the Invention

The integrated modular spraying system includes a tank, a hose spool, an elongate flexible hose and a pump. This system is suitable for applying various types of chemicals in either liquid or powder form. An applicator wand or gun is normally attached to one end of the flexible hose to facilitate application of the chemical. The invention is particularly suitable for use by exterminating companies for application of insecticides around the exterior of residential homes. The plastic tank used in the present invention includes a modular design which forms a frame to support the hose spool.

B. Description of the Prior Art

Exterminating companies use various systems for applying chemicals around and in homes. One common approach is a backpack sprayer with a hand operated pump which is described in FIG. 1 of U.S. pat. No. 4,651,903. In typical backpack sprayers, a hand operated lever operates a pump to transfer the liquid from the backpack to a target. This type of sprayer creates several difficulties for the operator. In the exterminating business, it is common for employees to visit between ten and twenty residential homes per day and to treat these homes for various pests. In this connection, the employee is typically assigned a company truck for hauling his equipment, inter alia, the backpack sprayer and suitable chemicals. At each stop, the employee first must lift and vigorously shake the backpack sprayer to mix the contents and then strap the sprayer to his back, carry it from the truck to the target and then constantly pump the lever to apply the necessary chemical. After he has completed the application, he carries the backpack to the truck and removes it. Several times during the day it might also be necessary to refill the backpack sprayer.

Backpack sprayers of this nature, when filled with liquid, may weigh from approximately thirty-five to forty-five pounds. It is therefore stressful for employees to carry around this load on a daily basis and to be continually taking it on and off. In addition, the pump requires repetitive pumping actions which may lead to various types of cumulative trauma distress including, but not limited to, carpel tunnel syndrome. The heavy pack makes operators more prone to falls and ankle and back injuries. When refilling, mixing or using the backpack, some of the chemicals may spill on the exterior and may ultimately come in contact with the clothing or skin of the operator. Although relatively economical to purchase and maintain, backpack sprayers have disadvantages from the operator's perspective.

Another common approach used by exterminating companies to apply chemicals in and around houses is a truck-mounted tank with pump and hose reel. With this type of apparatus, the operator parks the truck as close as possible to the home or other target. The operator then pulls a sufficient length of flexible hose from the reel to treat targets which are remote from the truck. After the application of the chemical is complete, the hose reel is rotated to retract and rewind the hose. Most hose reels have manual cranks for this purpose. A typical prior art truck-mounted system is Part No. 2000-15RP-M-H which is offered by Norel, a division of Oldham Chemical Company, located in Memphis, Tennessee. This truck-mounted system includes a metal frame supporting a plastic tank, a pump and a hose reel. The tank holds approximately fifteen gallons of liquid and the hose reel comes with approximately 150 feet of three-eights inch flexible hose. The entire apparatus weighs approximately one hundred pounds and is approximately twenty-eight inches long, thirty-eight inches wide and nineteen inches tall. This system is more user friendly than a backpack sprayer because the operator does not have to put the backpack on and off or carry it to and from each target on a repetitive basis. However, the truck-mounted system is substantially more expensive to purchase and maintain than the typical backpack sprayer. Typical truck-mounted systems provide 150 feet of hose.

The present invention is a truck-mounted spraying system which is more economical to manufacture and operate than conventional truck-mounted systems because it uses an integrated modular design. This modular design also allows for a compact apparatus which weighs approximately fifty pounds dry and which will fit inside of a two foot × two foot × two foot cube, for a twelve gallon model. In the preferred embodiment, the invention is equipped with 500 feet of three-eights inch hose. Other larger models could also be fabricated using this same integrated modular design. This compact design leaves more free space in a pickup truck which can be used for other purposes. The compact design allows the integrated modular spraying system to be mounted underneath the bed of larger trucks. This compact design allows for mounting of several different units in the back of one pickup truck. This multi-unit approach allows the operator to fill each unit with a different type of chemical.

Modern types of chemicals include micro-encapsulated spheres which provide for time release of the chemical. The present invention is particularly suited for use with micro-encapsulated chemicals which tend to be substantially higher in price than traditional chemicals and, therefore, tend to be applied in smaller amounts. Use of micro-encapsulated chemicals is more environmentally sound because of the time release aspect and because less of the chemical is released in the initial phases of treatment.

SUMMARY OF THE INVENTION

The present invention includes an integrated modular tank with a well formed in a wall and two opposing buttresses extending from the tank. A hose spool is supported by these buttresses and freely rotates in the well. A recess is formed in the top of this integrated modular tank to receive a pump for transferring the chemical from the tank through the hose to a remote target. In a typical application, the pump will include a twelve volt D.C. motor which is connected to the battery of a truck as a source of electricity.

The integrated modular spraying system can be mounted in the back of a pickup truck. In the alternative, it can be suspended underneath the bed of a larger truck or it could be mounted on a frame in or above the truck bed. When used by exterminating companies, the truck will typically be parked on the street in front of a residential home or in the driveway. The system can also be used in connection with apartments, condominiums or any other structure. In commercial applications, the truck will be parked as close as reasonably possible to a warehouse, plant or other commercial structure. The operator will turn the engine of the truck off and will turn the pump on. He will then pull a sufficient length of hose off of the hose spool so that he can apply the chemical to a remote target. In most situations, an applicator wand which contains an on/off valve and a removable tip will be attached to the end of the hose.

One feature of the present invention includes a pigtail ring assembly which facilitates 360° radial payout of the hose from any lateral direction. If, for example, the operator gets to the back side of the house or other structure and needs more hose, the pigtail ring assembly facilitates pulling more hose off the reel without requiring the operator to walk back to the vehicle. After the chemical has been applied to the target, the hose is removed from the pigtail ring assembly and the operator turns a crank to manually rewind the hose on the hose spool. This process is repeated by the operator at each stop during the day. From the operator's perspective, this system is more user friendly than conventional backpacks. From the owner's perspective, this system is more economical to purchase and maintain than prior art truck-mounted systems.

The integrated modular spraying system is suitable for applying various chemicals. The term "chemical" as used herein includes both liquids and dry flowables. Almost any kind of liquid could be applied with this system except those which would attack the tank. It is particularly suitable for pest control situations using modern safer, more costly liquid insecticides. It could also be used in horticultural applications to apply liquid fertilizers, herbicides and fungicides. Micro-encapsulated spheres in liquids can also be applied with this system. An alternative embodiment is suitable for applying dry flowables. The term "dry flowables," as used herein, includes boric acid dust, insecticidal dust, silica aerogel, antibiotic powder, powder baits and other dusts and powders.

BRIEF DESCRIPTION OF THE DRAWINGS

So that the manner in which the above-recited features, advantages and objects of the present invention are attained and can be understood in detail, a more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
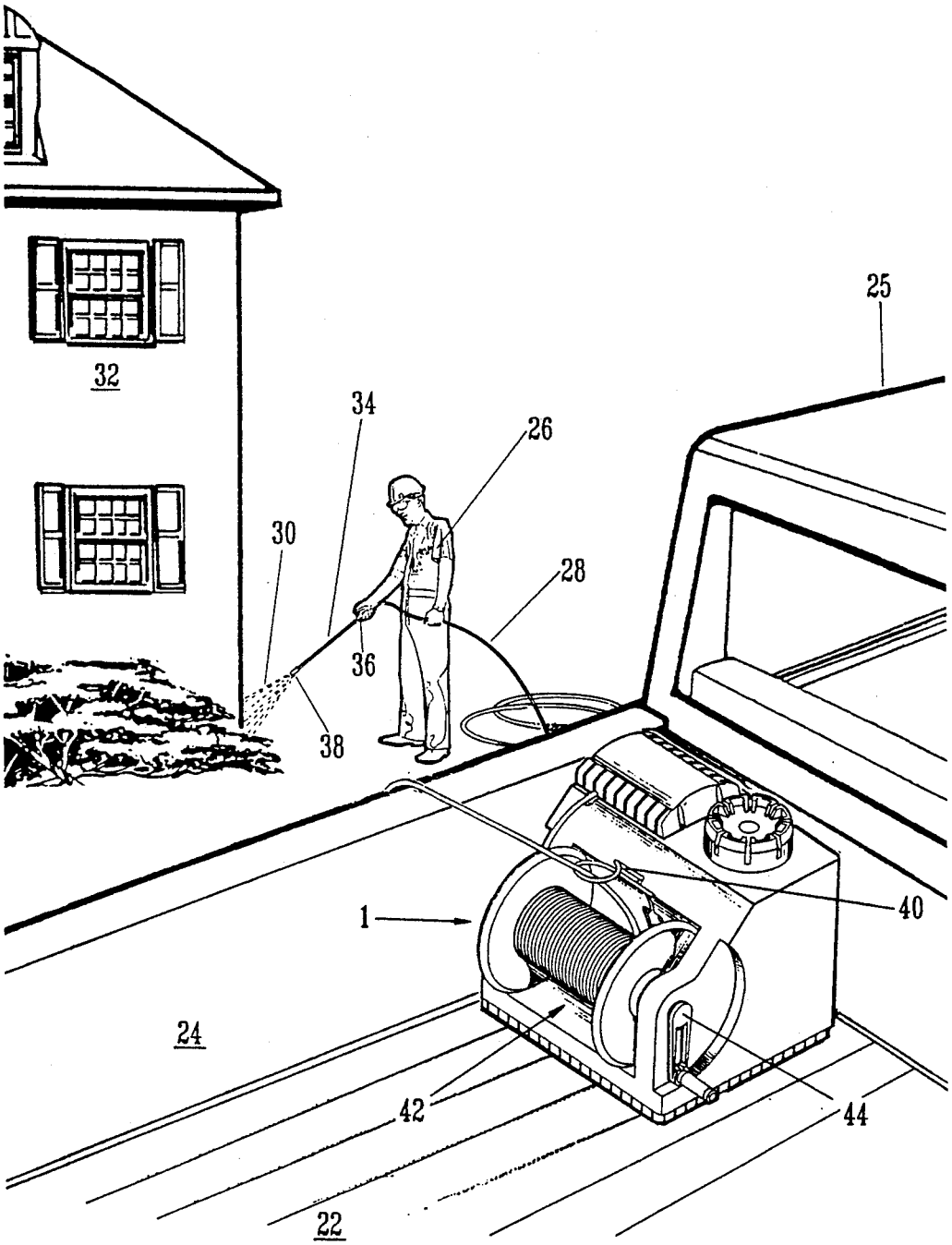
FIG. 1 is a perspective view of the integrated modular spraying system mounted in the back of a pickup truck with an operator spraying chemical around the exterior of a residential home.

Referring to FIG. 1, the integrated modular spraying system is generally identified by the numeral 1 and is mounted on the bed 22 in the back 24 of a pickup truck 25. The operator 26 has pulled a sufficient length of flexible hose 28 from the integrated modular spraying system 1 and is applying a chemical 30 along the exterior of a residential home 32.

Attached to the end of the hose 28 is a wand 34 which includes an on/off valve or trigger 36. The wand 34 also includes a removable nozzle 38 which typically is available in different orifice sizes. The on/off valve 36 can be selectively actuated by the operator 26 to control the application of chemical.

The hose 28 is shown feeding through the pigtail ring assembly 40 which facilitates pulling the flexible hose 28 off of the hose spool 42. When the operator 26 has finished applying chemical on or about the house 32, he will disengage the hose 28 from the pigtail ring assembly 40 and will manually turn the hand crank assembly 44 to rewind the flexible hose 28 about the hose spool 42. He will use one hand to turn the hand crank assembly 44 and the other hand to guide the hose 28 as it is wound about the hose spool 42.

Figure 2:
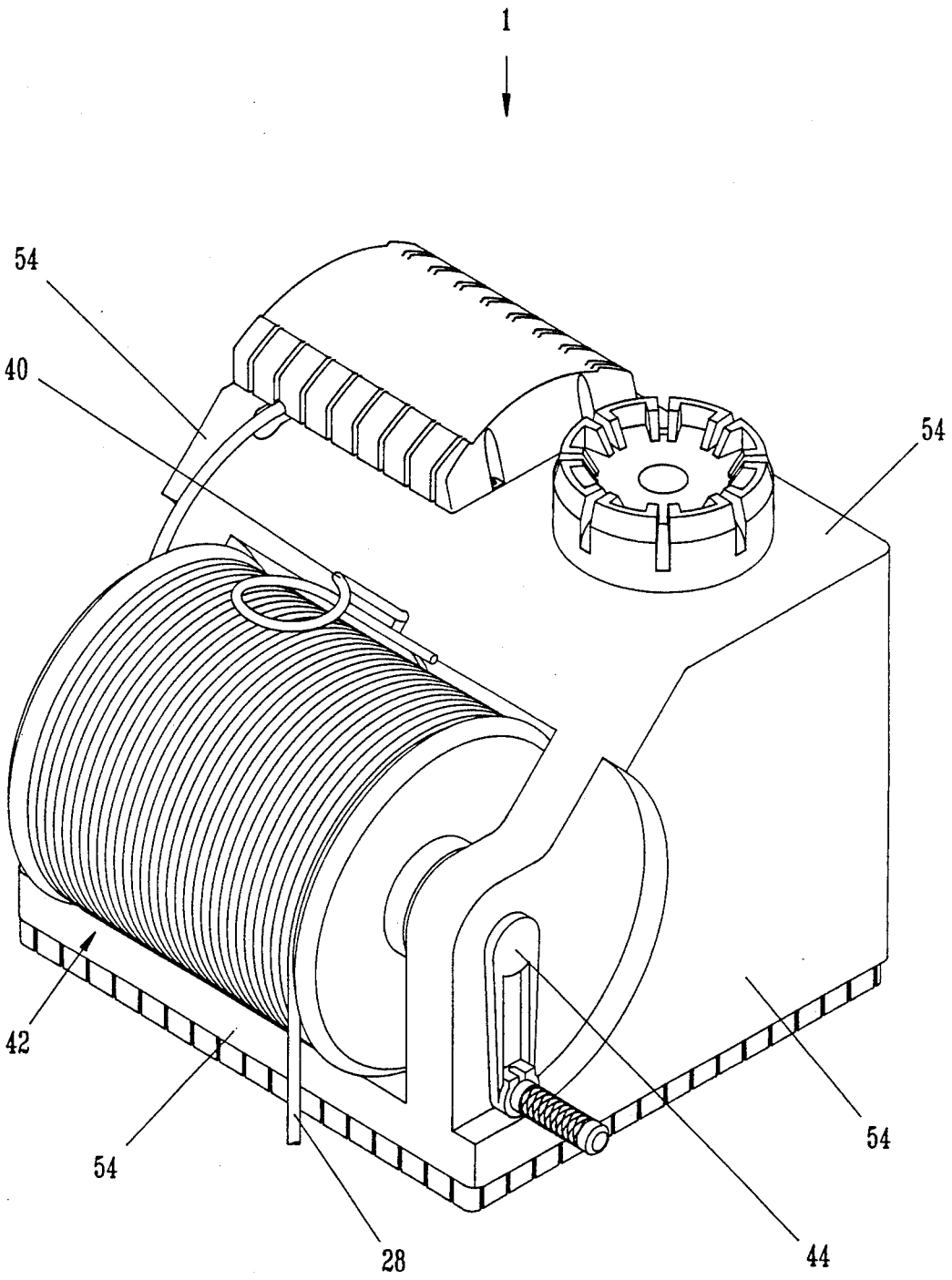
FIG. 2 is a perspective view of the integrated modular spraying system with the hose spool full of flexible hose. The articulated handle for the hand crank assembly is shown in the extended position.

Referring to FIG. 2, the integrated modular spraying system 1 is shown in enlarged perspective view. The tank 54 is preferably formed from high density polyethylene or other suitable material. In the preferred embodiment, use of rotomolding and the integrated modular design of the tank 54 and the hose spool 42 reduce manufacturing costs for the present invention.

Figure 3:
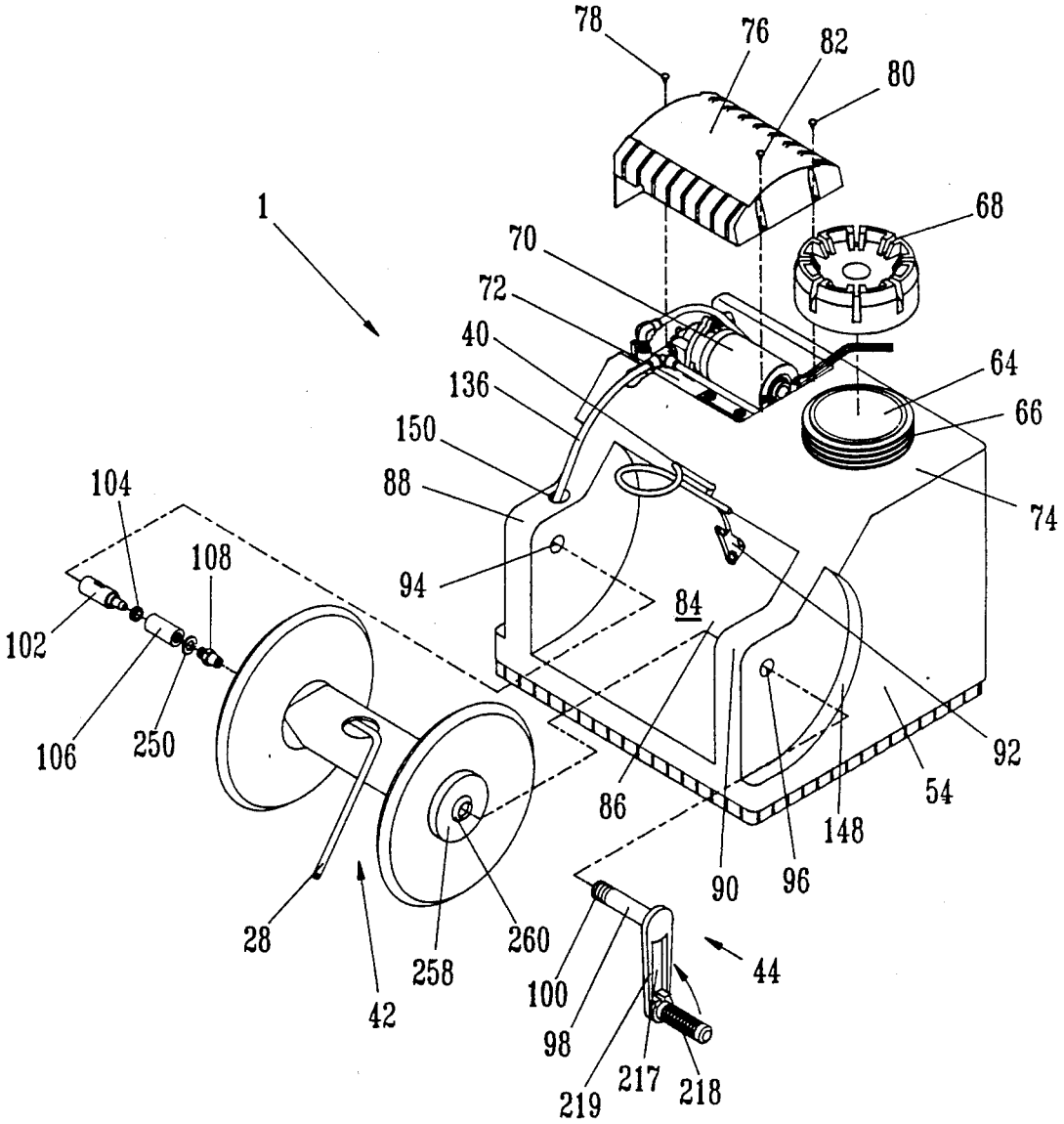
FIG. 3 is an exploded view of the integrated modular spraying system with the hose spool removed from the well, the tank cap removed from the fillwell and the pump cover removed from the pump recess.

Referring to FIG. 3, the integrated modular spraying system 1 is shown in exploded perspective view. The interior 64 of the tank 54 can be accessed by the opening in the fillwell 66. A tank cap 68 threadably engages the fillwell 66. A pump 70 is mounted in a recess 72 formed in the top wall 74 of the tank 54. A pump cover 76 is sized and dimensioned to cover the pump 70 and the recess 72. The first pump cover screw 78, a second pump cover screw 80 and a third pump cover screw 82 removably attach the pump cover 76 to the tank 54. A well 84 is formed in front sidewall 86 of the tank 54. A first buttress 88 extends from the tank 54 and a second buttress 90 likewise extends from the tank 54, further defining the shape of the well 84. The pigtail ring assembly 40 nestles in a receptacle 92 formed in front sidewall 86 of the tank 54. A hole 94 is formed through the first buttress 88 and a second hole 96 is formed in the second buttress 90. Holes 94 and 96 are aligned along the same center line axis.

The tank 54 is defined by a back sidewall 3, a left sidewall 4, a right sidewall 5, a front sidewall 86, a top wall 74, a bottom wall 176, the first buttress 88 and the second buttress 90. A semicircular recess 149 is formed in left sidewall 4 adjacent the first buttress 88. A second semicircular recess 148 is formed in right sidewall 5 adjacent the second buttress 90. The first recess 149 and the second recess 148 add rigidity and strength to the design and are ascetically appealing.

The hand crank assembly 44 includes a protruding shaft 98 which is threaded on the end 100. As shown by the indicator lines, the shaft 98 of the hand crank assembly 44 fits through the aperture 96 in the second buttress 90. The threaded shaft 98 engages the hose spool 42 and when turned imparts rotational force to the hose spool 42. On the side of the hose spool 42 opposite from the hand crank assembly 44 is a male swivel body 102, a seal 104, a female swivel body 106, a washer 250 and a fitting 108. The male swivel body 102 is mounted in a stationary position in the hole 94 of the first buttress 88 as better seen in the section view shown in FIG. 7. The female swivel body 106 is rigidly attached to the interior of the hose spool 42. The female swivel body 106 rotates about the male swivel body 102 when the operator turns the hand crank assembly 44, causing the hose spool 42 to freely rotate.

Figure 4:
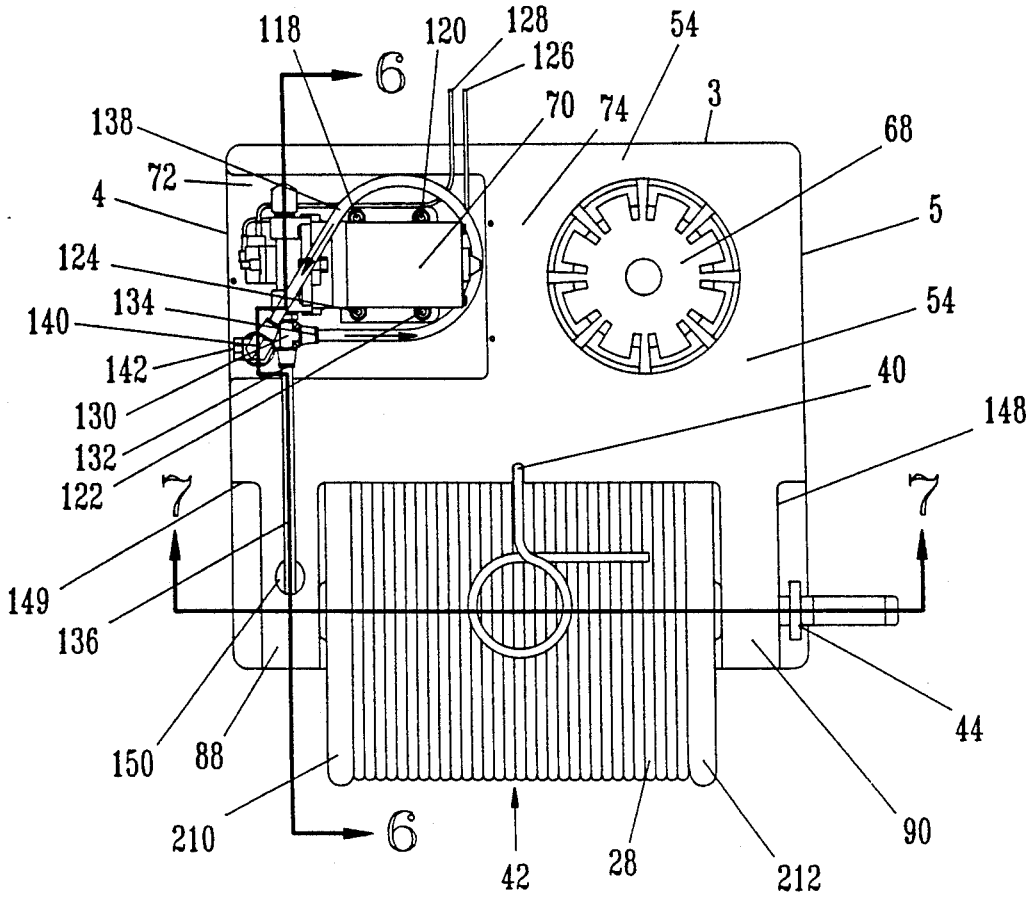
FIG. 4 is a top plan view of the integrated modular spraying system.

Referring to FIG. 4, the tank 54 is shown in top plan view. The pump cover 76 has been removed to make it easier to see the pump 70 which is positioned in the recess 72. The pump 70 is secured in the recess 72 by a first pump mounting screw 118, a second pump mounting screw 120, a third pump mounting screw 122 and a fourth pump mounting screw 124, as better seen in FIG. 20.

The electric motor in the pump 70 is connected by a first wire 126 and a second wire 128 to a twelve volt power source such as the battery in the vehicle. The outlet port of the pump 70 is connected to a "T" fitting 130 which has a first outlet 132 and a second outlet 134. The first outlet 132 connects to an output hose 136 which delivers the chemical to the flexible hose 28 via the swivel assembly 198 for application to a remote target.

The second outlet 134 of the "T" fitting 130 connects to a bypass hose 138. At the other end of the bypass hose 138 is a fitting and bypass valve 140. A handle 142 can be manually actuated to open or close the bypass valve 140. When in the open position, the bypass valve 140 allows chemical to flow from the "T" fitting 130 through the bypass hose 13 through the fitting and bypass valve 140 back to the agitation hose 144, as better seen in FIG. 6. When the bypass valve 140 is in the closed position, chemical moves through the output hose 136 to the hose 28 for application to a remote target. A hose aperture 150 is formed in the top of the first buttress 88 to receive the output hose 136 and fitting 234 so that it can be connected to the male swivel body 102 of the swivel assembly 198, as better seen in FIG. 6.

Applicant recommends a twelve volt, 2.6 gallon per minute, 60 PSI pump for this particular application with a twelve gallon tank. Applicant believes that a SHURflo 8,000 series pump with the above specifications is suitable for this application. The SHURflo Company is located in Santa Ana, California. Those skilled in the art will understand that other pumps with different operating parameters may also be suitable for this application.

The output pressure for the aforementioned SHURflo pump can be adjusted with an allenhead wrench which can be inserted through the aperture 166 in the pump cover 76. The aforementioned pump is equipped with a pressure switch and sensor. If the sensor determines that pressure at the output side of the pump has reached a predetermined value, for example 50 PSI, then the switch shuts the pump off. If the operator 26 turns the on/off valve 36 on the wand 34 on, the pressure on the output side of the pump drops to near 0 PSI. The sensor immediately senses the pressure drop and the switch turns the pump on to restore pressure on the output side to a predetermined level. Those skilled in the art will recognize and understand the operation of this prior art pressure switch and sensor.

When the on/off valve 36 on the wand 34 is on and the bypass valve 140 is closed, the sensor turns the pump 70 on to deliver chemical to the wand 34. If the on/off valve 36 is off and the bypass valve 40 is closed, the sensor turns the pump 70 off. If the on/off valve 36 is off and the bypass valve 140 is open, the sensor will turn the pump 70 on and the system will operate in the agitation or recirculate mode to stir and mix the chemical in the tank 54. If the bypass valve 140 is open, it is assumed that the operator 26 will leave the on/off valve 36 in the wand off to facilitate agitation and recirculation.

Figure 5:
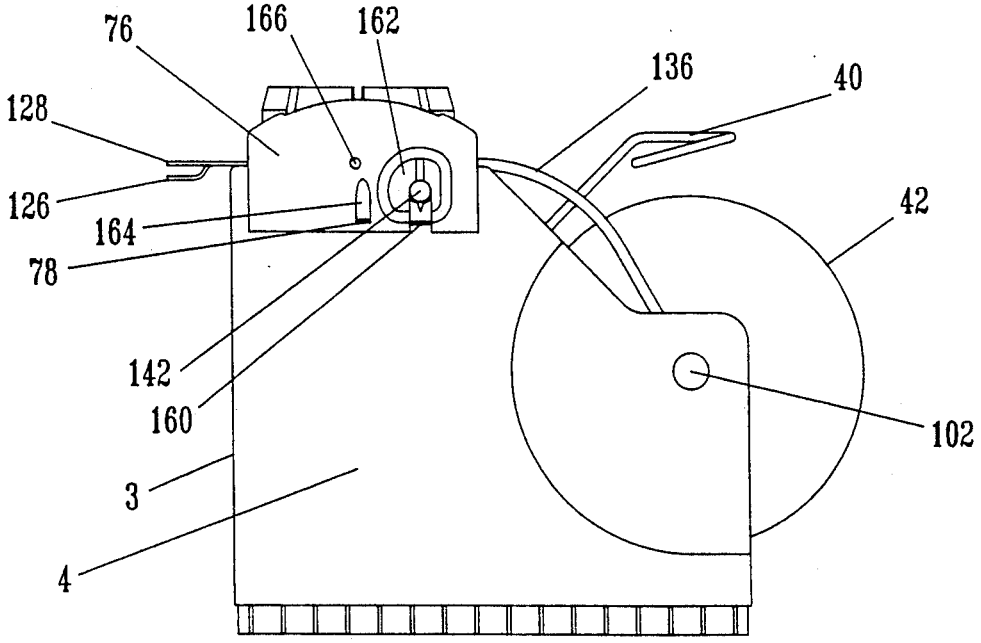
FIG. 5 is a left side elevation view of the integrated modular spraying system as shown in FIG. 2.

Referring to FIG. 5, the tank 54 is shown from a left side elevation view. The pump cover 76 is mounted on the top of the tank 54. The wires 126 and 128 extend underneath the pump cover 76 and are attached to the electrical system of the vehicle. A slot 160 is formed in the bottom side of the pump cover 76 and a recess 162 is likewise formed in the side of the pump cover 76 to receive and fit over the handle 142 of the bypass valve 140. This recess 162 allows the operator 26 to grasp the handle 142 and actuate the bypass valve 140 when the pump cover 76 is in place. A screw recess 164 is likewise formed in the side of the pump cover 76 to receive the screw 78. An aperture 166 is formed in the side of the pump cover 76 allowing access to the pump 70 for adjustment of output pressure as described above.

Figure 6:
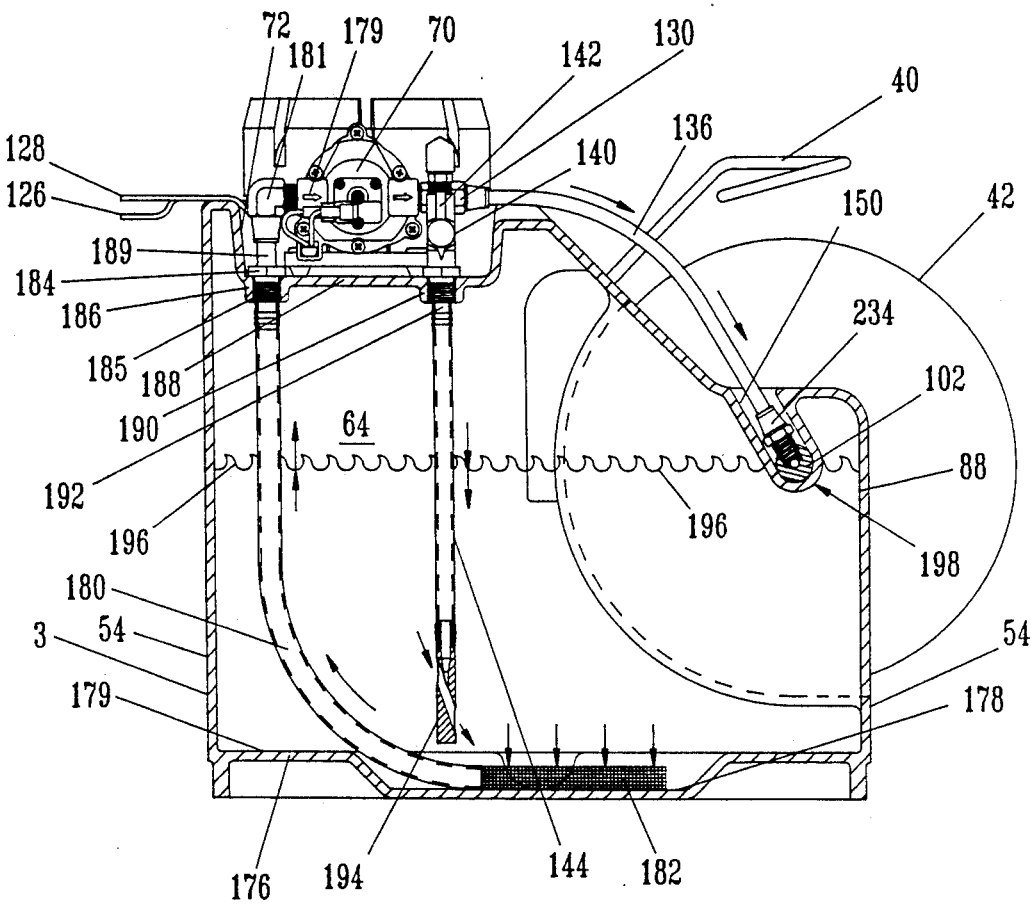
FIG. 6 is a section view of the integrated modular spraying system along the line 6—6 of FIG. 4.

Referring to FIG. 6, the tank 54 is shown in partial section view along the line 6—6 of FIG. 4. The bottom 176 of the tank 54 includes a sump 178 which is lower than the floor 179 on the inside 64 of the tank 54. One end of the pump suction hose 180 is connected to a filter screen 182 and the other end is connected to the barbed portion of the inlet fitting 184. The inlet fitting 184 includes a barbed portion 183, a threaded portion 185, a hex portion 187 and an elongated portion 189. The end of the elongated portion 189 of the inlet fitting 184 is crimped in a 90° elbow fitting 181 which connects to the suction side 179 of the pump 70.

The screen 182 and the suction hose 180 rest in the sump 178 of the tank 54. A boss 186 is formed in the bottom 188 of the recess 72 to threadably engage the threaded portion 185 of the inlet fitting 184. A second boss 190 is also formed in the bottom 188 of the recess 72 to threadably receive the agitator fitting 192. The inlet fitting 184 and the agitator fitting 192 are preferably formed from brass or Delrin thermoplastic. One end of the agitator hose 144 is connected to the barbed extension protruding from the agitator fitting 192. The other end of the agitator hose 144 is connected to a venturi nozzle assembly 194, as is better seen in FIG. 9.

The liquid level of the chemical is indicated by the wavy line 196 on the interior 64 of the tank 54. The chemical enters the screen 182 as indicated by the flow arrows. When the operator 26 turns the on/off valve 36 on, negative pressure is created by the pump 70 in the suction hose 180 which causes the chemical to move up the hose to the suction side of the pump as indicated by the flow arrows. Assuming that the bypass valve 140 is in the closed position, the chemical then passes through the pump 70 and the "T" fitting 130 through the output hose 136 and the fitting 234 to the swivel assembly 198 into the hose 28 for application to a remote target.

If the bypass valve 140 is open, the chemical passes through the "T" fitting 130 to the agitator hose 144 and through the venturi nozzle 194. This causes the agitator hose 144 to swing to and fro on the interior 64 of the tank 54, agitating and mixing the chemical. A jet action is also created by the venturi nozzle 194, further agitating the chemical.

Figure 7:
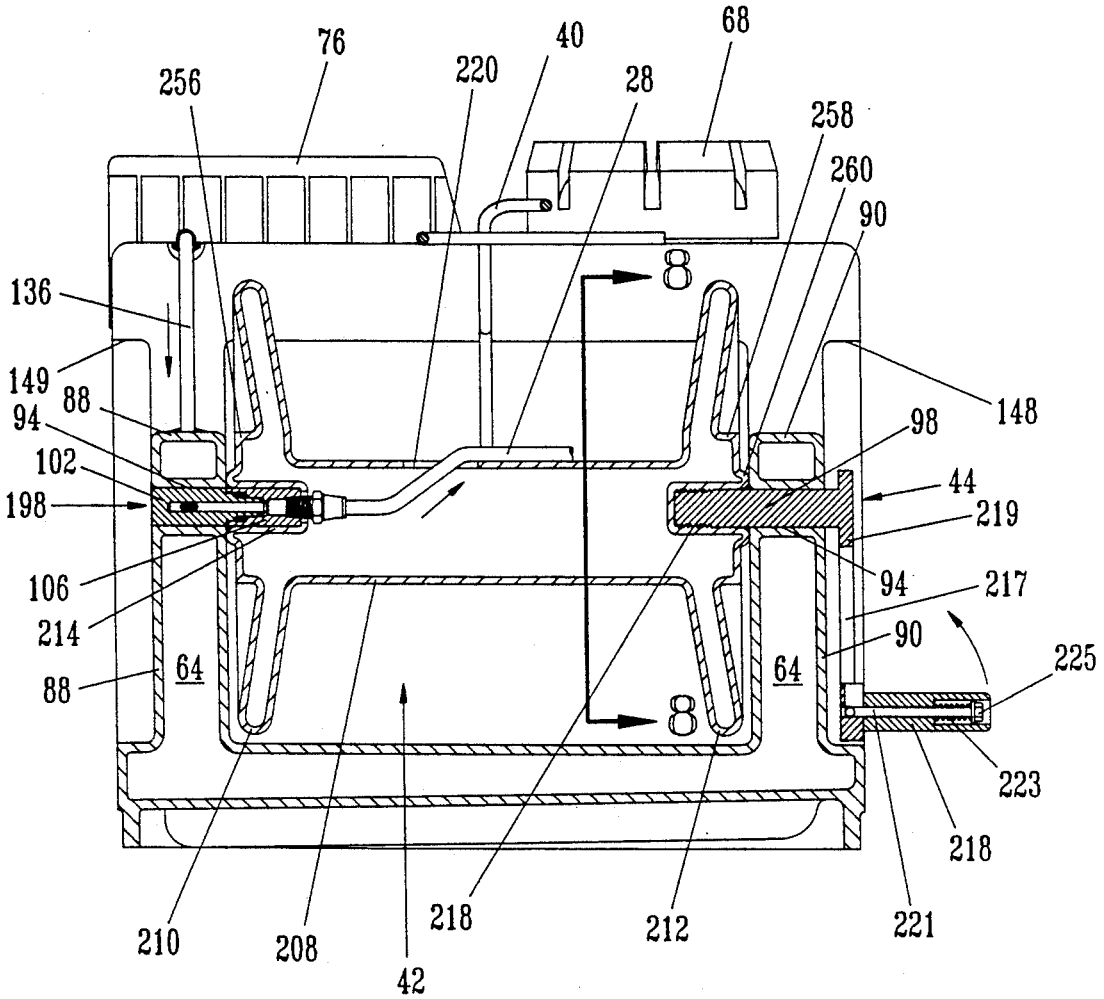
FIG. 7 is a section view of the hose spool and tank along the line 7—7 of FIG. 4.

Referring to FIG. 7, the hose spool 42 is shown in section view with a portion of the tank 54 along the line 7—7 of FIG. 4. The hose spool 42 includes a barrel 208, a first rim 212 positioned on one end of the barrel 208 and a second opposing rim 212 positioned on the other end of the barrel 208. A cylindrical recess 214 is formed in the first rim 210 to receive the female swivel body 216. An opposing cylindrical recess 218 is formed in the second rim 212 to threadably receive the shaft 98 of the hand crank assembly 44. The barrel 208 is hollow and includes an access port 220 which receives the hose 28. The access port 220 facilitates assembly of the swivel assembly 198.

The first buttress 88 includes a hole 94 therethrough which receives the male swivel body 102. A fitting 234 is positioned in the hose channel 150. The fitting 234 threadably engages the male swivel body 102 holding it in a stationary position so that the male swivel body 102 does not rotate when the hose spool 42 is rotated. The second buttress 90 includes an aperture 94 which forms a bearing for the shaft 98 of the hand crank assembly 44. A liner can also be placed in the aperture 94 to reduce wear on the tank 54. When the handle 218 is rotated, the shaft 98 rotates imparting rotational movement to the hose spool 42 which causes the female swivel body 106 to rotate about the stationary male swivel body 102 held in a stationary position in the first buttress 88.

The hand crank assembly 44 is preferably formed from cast aluminum. However, those skilled in the art will recognize that other substances may be suitable for this application. The handle 218 is articulated and can fold into a recess 217 in the arm 219 as shown by the arrow. The elongate handle 218 has a central bore aligned along the longitudinal axis. A T-shaped shaft 221 is mounted in the bore. A spring 223 slips over one end of the T-shaped shaft and is held in place by a nut 225 and washer. When the handle 218 is folded towards the recess 217 in the arm 219 as shown by the arrow, the spring 223 is compressed allowing the handle 218 to move from the extended position to the retracted position as will be readily understood by those skilled in the art.

Figure 8:
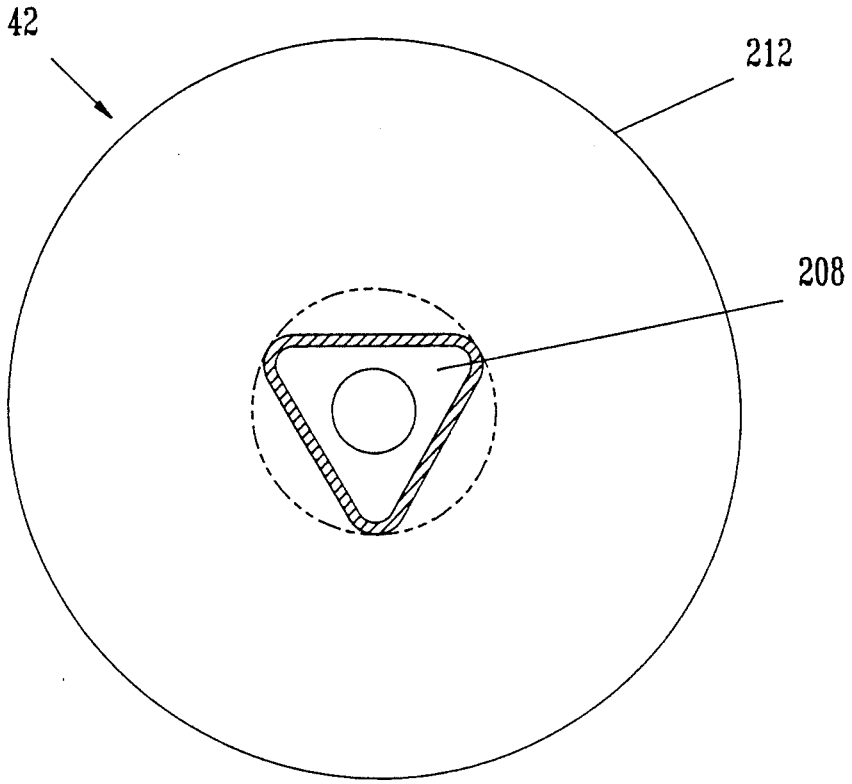
FIG. 8 is a section view of the hose spool along the line 8—8 of FIG. 7.

Referring to FIG. 8, the hose spool 42 is shown section view along the line 8—8 of FIG. 7. The triangular-shaped barrel 208 imparts rigidity to the hose spool 42.

Figure 9:
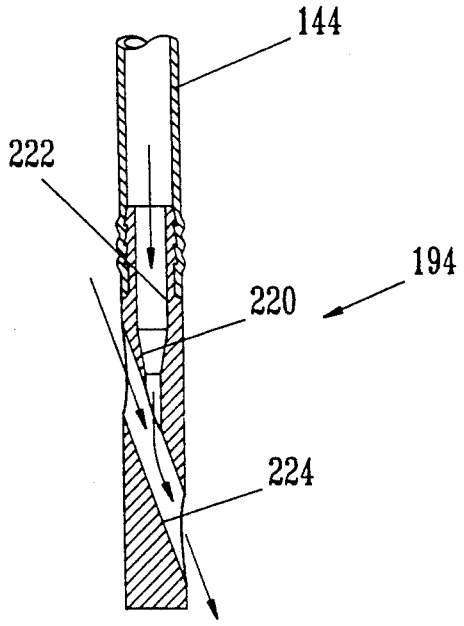
FIG. 9 is an enlarged section view of the venturi nozzle and a portion of the agitator hose.

FIG. 9 is an enlarged view of the agitator hose 144 and the venturi nozzle assembly 194. A restriction 220 is formed in the longitudinal bore 222 of the venturi nozzle assembly 194. A tangential passageway 224 intersects the longitudinal bore 220 downstream of the restriction 220. A venturi effect or jet action is created by the restriction 220 which causes the chemical to move through the bore 224 as shown by the flow arrows in the drawing. This jetting action serves to agitate the chemical in the tank 54. This jetting action also causes the agitator hose 144 to move about on the inside of the tank 54 which helps to keep the chemical mixed. When chemical is flowing through the venturi assembly 194, this may be referred to as the recirculation or agitation mode.

Figure 10:
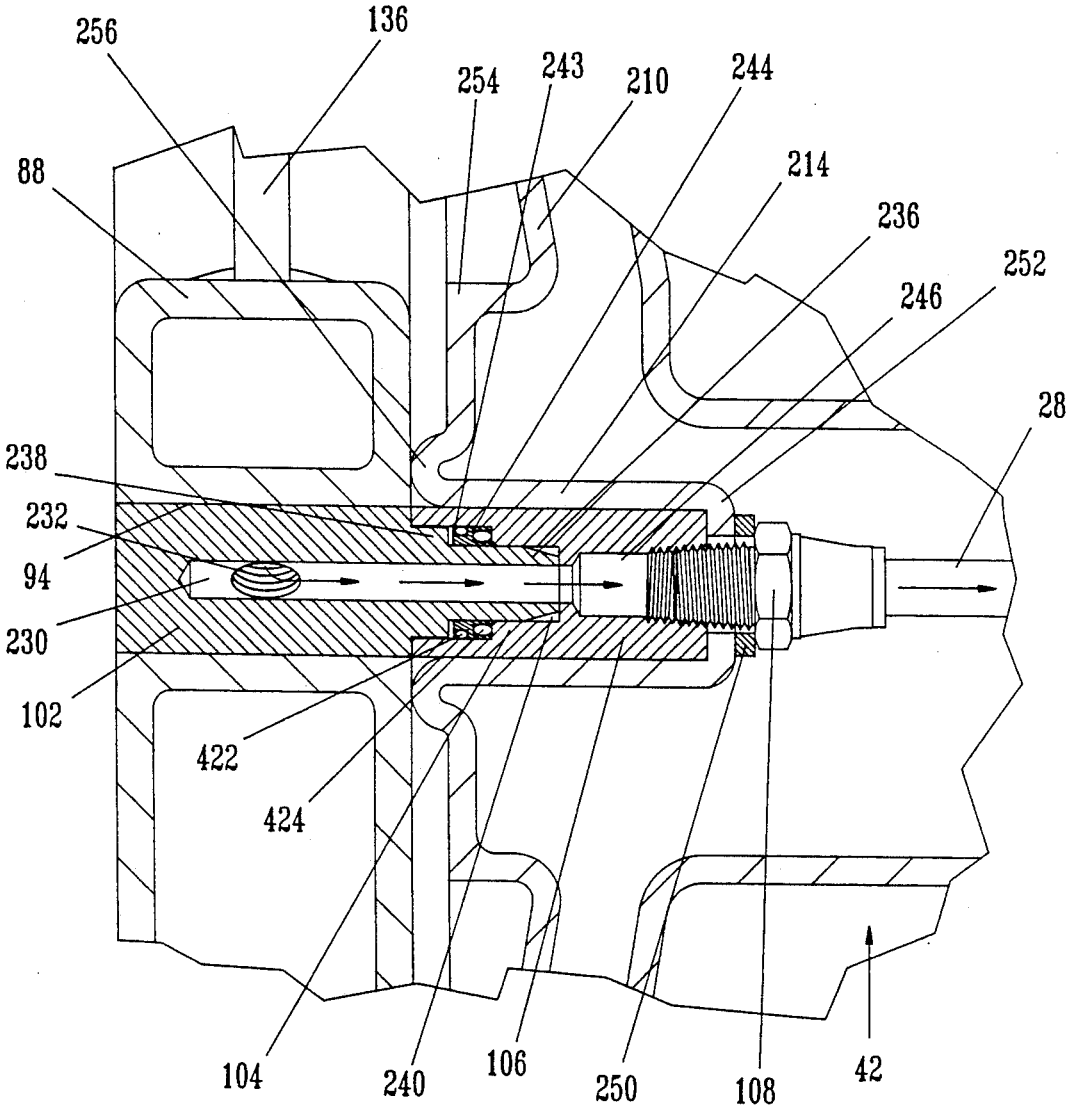
FIG. 10 is an enlarged section view of the swivel assembly shown in FIG. 7.

FIG. 10 is an enlargement of the swivel assembly 198 showing the first buttress 88 and the first rim 210 of the hose spool 42. An aperture 94 is formed through the first buttress 88 to receive the male swivel body 102. A bore 230 is formed along the longitudinal axis of the male swivel body 102. An inlet port 232 is drilled in the side of the male swivel body 102 and is in fluid communication with the bore 230. A fitting 234, not shown in this figure, is positioned in the hose channel 150 and threadably engages the inlet port 232, thus holding the male swivel body 102 in a stationary position in the first buttress 88. Fluid passes from the pump 70 through the outlet hose 136 through the fitting 234 and the inlet port 232 into the bore 230, as shown by the flow arrows.

One end of the male swivel body 102 forms an elongate stationary axle 236 which expands to an enlarged shoulder 238. Both the axle 236 and the shoulder 238 are load bearing members which support the female swivel body 106 and the hose spool 42. The female swivel body 106 includes a central bore 240 sized and dimensioned to receive the elongate stationary axle 236. The bore 240 expands to an enlarged diameter 243 to fit over the shoulder 238 of the male swivel body 102. The female swivel body 106 rotates about the stationary elongate axle 236 and the shoulder 238.

A seal chamber 244 is formed in the annular area between the axle 236 of the male swivel body 102 and the enlarged diameter 243 in the female swivel body 106. A seal 104 fits inside of the seal chamber 244 to provide a fluid-tight seal between the male swivel body 102 and the female swivel body 106. An outlet port 246 is formed in one end of the female swivel body 106 and threadably receives a fitting 108 which is crimped about one end of the flexible hose 28. A washer 250 is positioned between the fitting 248 and the back side 252 of the recess 214 thus securing the female swivel body 106 in a fixed position.

The left rim 210 of the hose spool 42 includes a circular shoulder 254 and circular locating boss 256. The opposing rim 212 likewise includes a circular shoulder 258 and a locator boss 260. The purpose of the locator bosses 256 and 260 is to provide as tight a fit as possible for the hose spool 42 between the first buttress 88 and the second buttress 90. The locator bosses 256 and 260 serve to minimize the amount of slop between the male swivel body 102 and the female swivel body 106. Depending on manufacturing tolerances, the length of the elongate stationary axle 236, the shoulder 238 and the size of the seal chamber 244 must be long enough to allow for a certain amount of slop between the hose spool 42 and the buttresses 88 and 90 and still maintain a fluid-tight seal.

Figure 11:
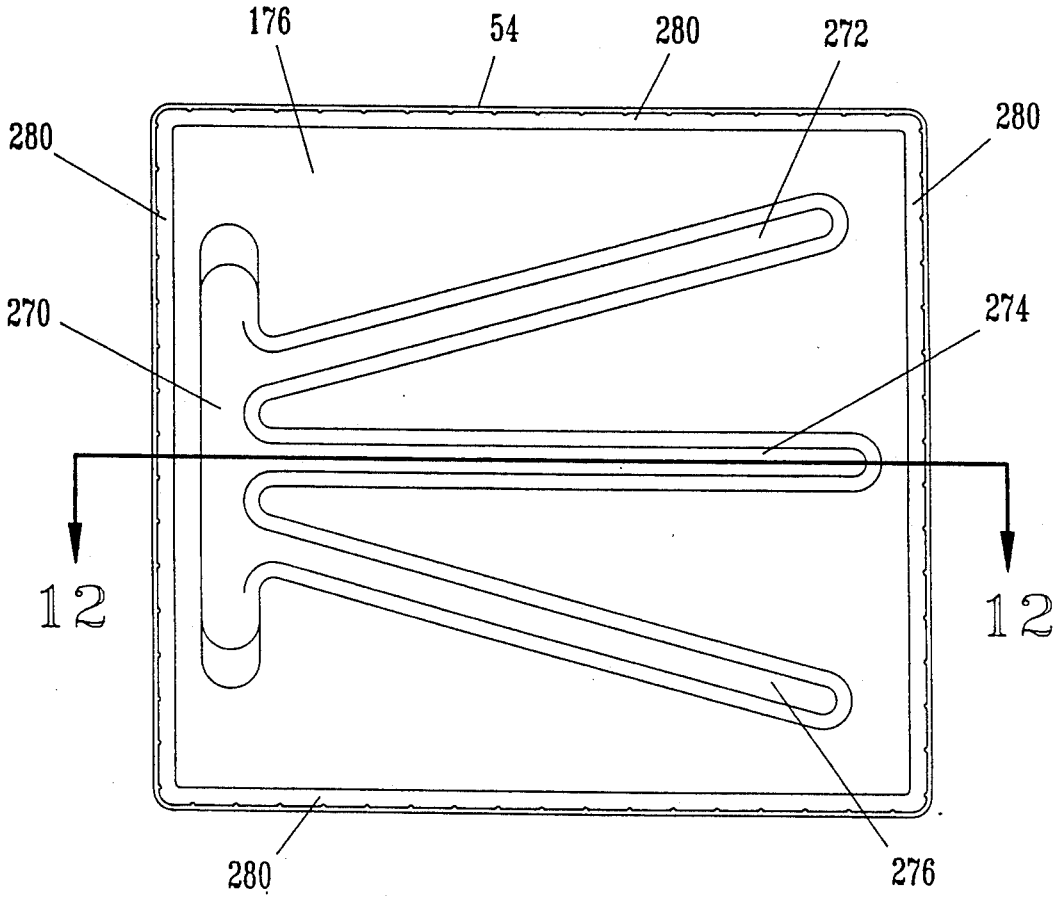
FIG. 11 is a bottom plan view of the tank.

FIG. 11 is a bottom plan view of the tank 54. A protrusion 270 extends from the bottom 176 of the tank 54. This protrusion forms the sump 178, better seen in FIG. 6. A first lateral channel 272, a second lateral channel 274 and a third lateral channel 276 connect with the sump 178. The aforementioned lateral channels angle downward towards the sump 178 to facilitate drainage of any residual liquids to the sump 178 to fully empty the tank 54 and to add structural rigidity to the bottom 176.

Figure 12:
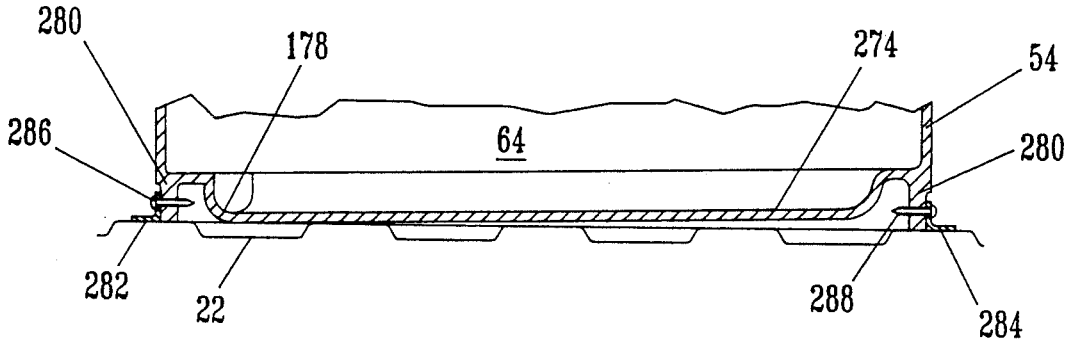
FIG. 12 is a section view of a portion of the bottom of the tank along the line 12—12 of FIG. 11. This figure shows the tank mounted to the bottom of a pickup truck with angle iron.

FIG. 12 is a section view of the tank 54 in section view along the line 12—12 of FIG. 11. The lateral channel 274 angles downward towards the sump 178 to drain all liquids toward the sump 178. The tank 54 includes a foot 280 which extends around the outside perimeter of the tank 54. In order to secure the tank 54 to the truck bed 22, a first angle iron 282 and a second angle iron 284 are welded or otherwise attached to the bed 22 of the pickup truck 25. A plurality of attaching screws 286 and 288 pass through the angle iron and threadably engage the foot 280 along the bottom perimeter of the tank 54. At least two angle irons are recommended for securing the tank 54; however, as a matter caution, additional angle irons could be added to the other sides of tank 54.

Figure 13:
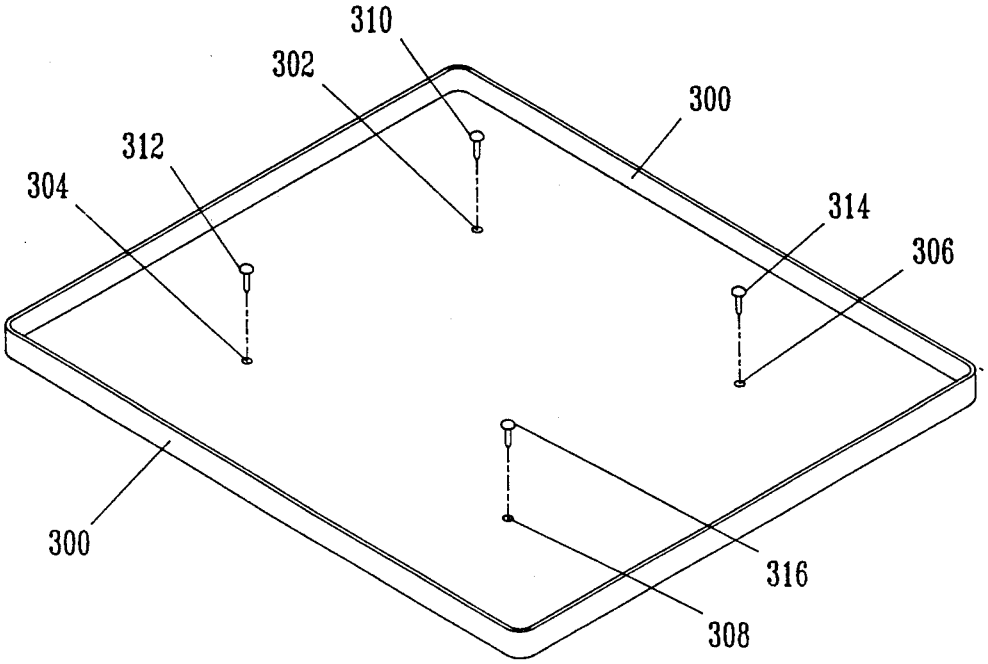
FIG. 13 is a perspective view of a mounting frame.

FIG. 13 is a perspective view of a mounting bracket 300 which can be stamped from metal or formed from plastic as a matter of manufacturing convenience.

A first hole 302, a second hole 304, a third hole 306 and a fourth hole 308 are placed in the bottom of the mounting bracket 300. A first mounting bracket screw 312 engages the first hole 302. A second mounting bracket screw 312 engages the hole 304. A third mounting bracket screw 314 engages the hole 306 and a fourth mounting bracket screw 316 engages the fourth hole 308. These screws attach the mounting bracket 300 to the bed 22 of a pickup truck 25 or other surface.

Figure 14:
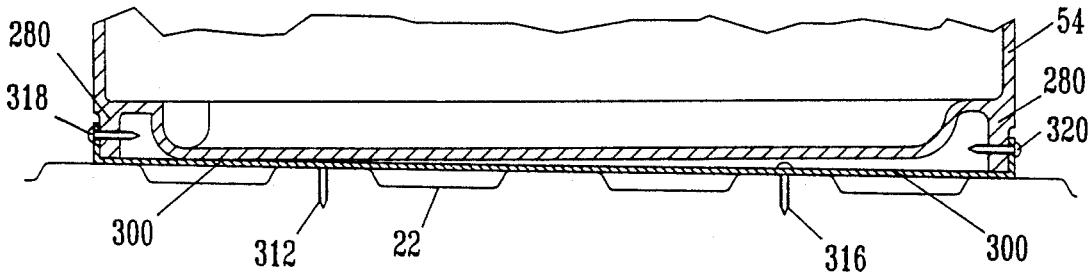
FIG. 14 is section view of a portion of the bottom of the tank similar to FIG. 12, except the mounting frame shown in FIG. 13 is secured to the bottom of the system and the entire apparatus is secured to the bed of a pickup truck.

Referring to FIG. 14, the mounting bracket 300 is secured to the bed 22 of the pickup truck 25 by mounting screws 312 and 316. A plurality of screws 318 and 320 pass through the mounting bracket 300 and engage the foot 280 around the bottom of the tank 54. This mounting system can also be used to mount the tank 54 on a frame above the bed of a truck to allow more storage underneath the frame and tank.

Figure 15:
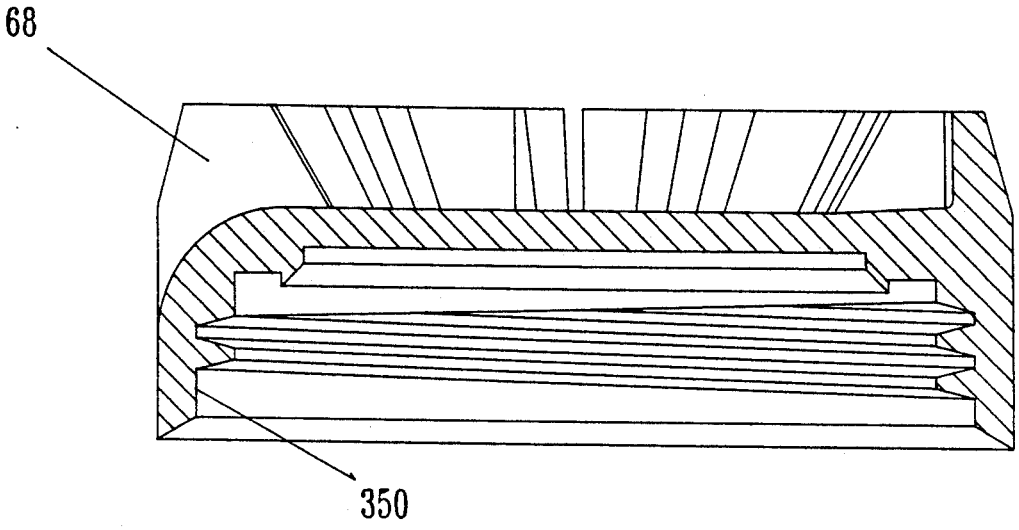
FIG. 15 is a section view of the tank cap.

Referring to FIG. 15, the tank cap 68 is shown in section view. The interior diameter 350 of the tank cap 68 is threaded to threadably engage the fillwell 66, as best seen in FIG. 3.

Figure 16:
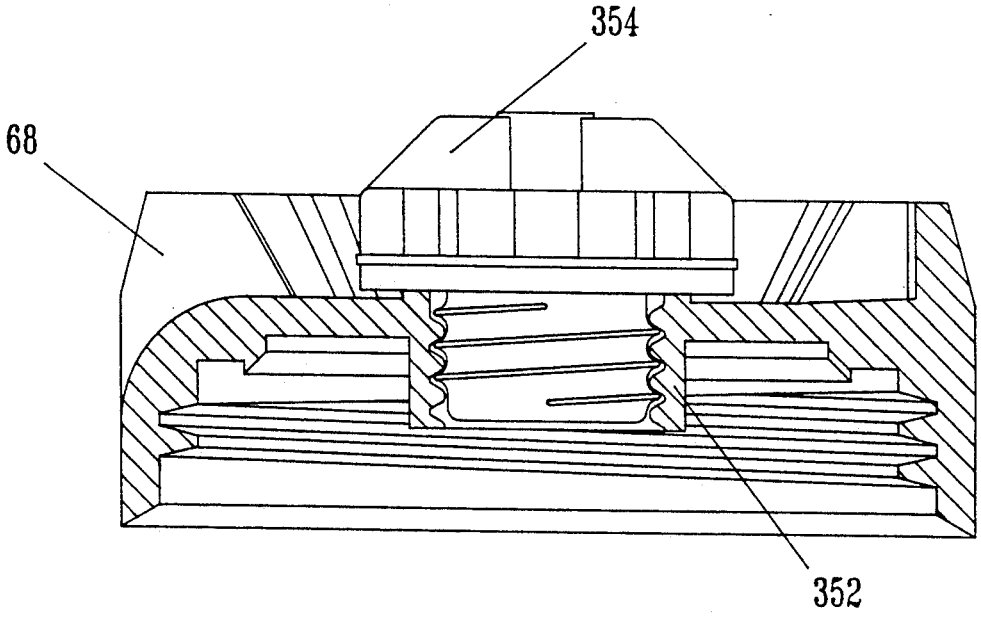
FIG. 16 is a section view of an alternative embodiment of the tank cap, including a removable and lockable inner cap such as those used on conventional automobiles.

Referring to FIG. 16, the tank cap 68 is shown in an alternative embodiment with a neck 352 formed in the center of the cap. The interior diameter of the neck 352 is threaded to receive a conventional locking gas cap 354. In this alternative embodiment, the tank cap 68 would be rigidly attached to the fillwell 66 by a screw or other means. This would limit access to the interior 64 of the tank 54 through the neck 352. The locking gas cap 354 would be a means for easily and economically controlling access to the interior 64 of the tank 54. The locking gas cap 354 is readily available at any auto parts store and contains a one-way vent which allows air into the interior 64 of the tank 54 but does not allow vapor to exit from the gas cap 354.

Figure 17:
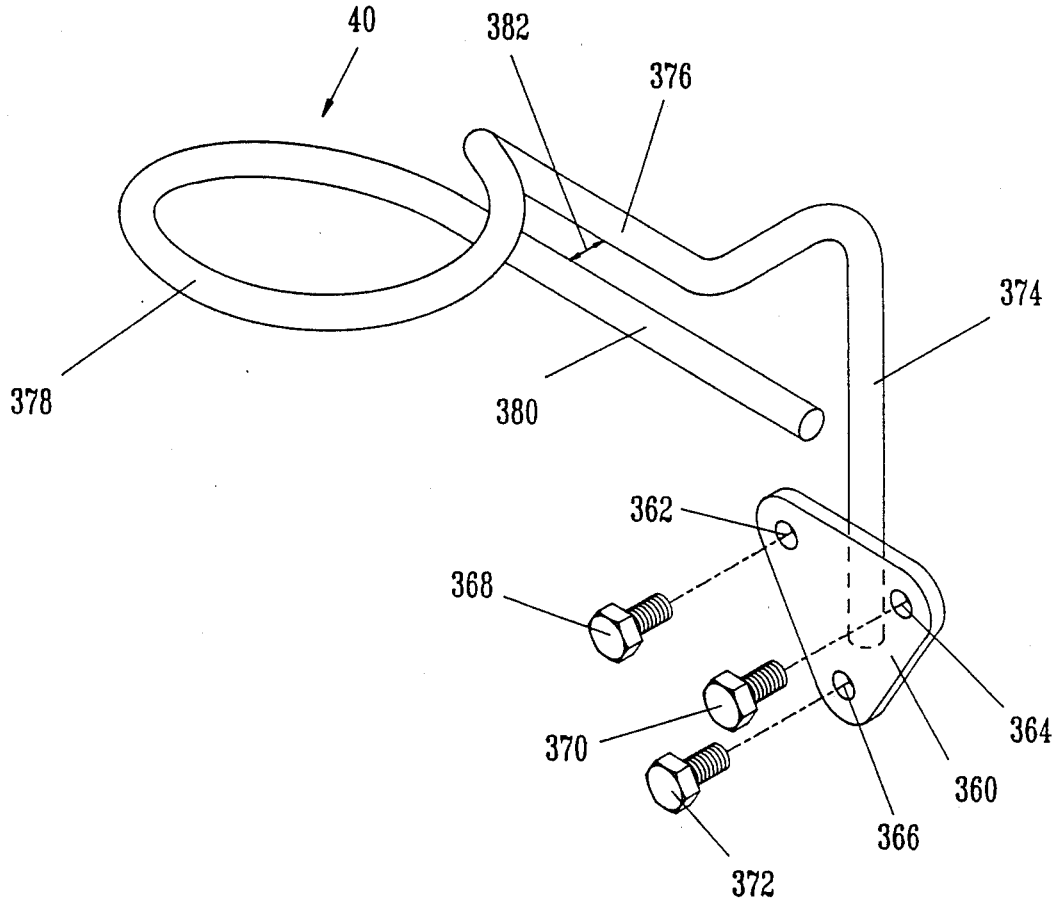
FIG. 17 is a perspective view of the pigtail ring assembly and three bolts for connecting the assembly to the integrated modular tank.

Referring to FIG. 17, the pigtail ring assembly 40 is shown in perspective view. The ring includes a base 360 which has a first hole 362, a second hole 364 and a third hole 366 formed therein. A first bolt 368 is sized and dimensioned to pass through the first hole 362. A second bolt 370 is sized and dimensioned to fit through the second hole 364 and a third bolt 372 is sized and dimensioned to fit through the third hole 366.

The pigtail ring assembly 40 includes an upstanding vertical portion 374 which is bent into a diagonal portion 376, which is then bent into a circular portion 378 which finishes with an elongate portion 380 to complete the construction of the pigtail ring assembly 40. There is a gap 382 between the elongate portion 380 and the diagonal portion 376 which allows the hose 28 to be freely inserted or removed from the pigtail ring assembly 40.

Figure 18:
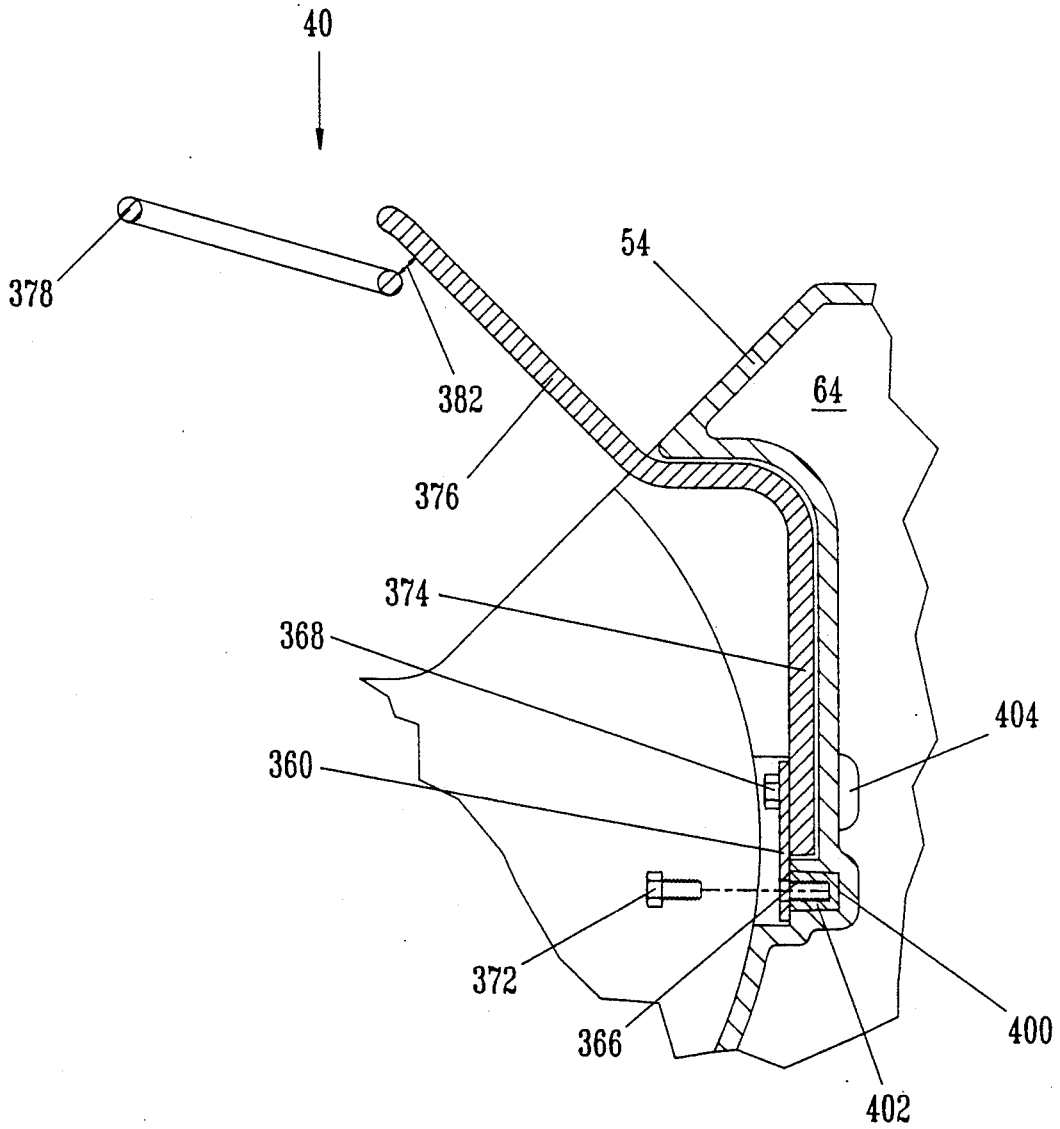
FIG. 18 is a partial section view of the tank as it engages the pigtail ring assembly.

FIG. 18 is a section view of the pigtail ring assembly 40 attached to the tank 54. A first boss 400 is formed in the side of the tank 54 and is rotomolded with a female threaded insert 402 in place. The metal insert 402 receives the bolt 373 which passes through the hole 366 in the base 360 of the pigtail ring assembly 40. A second boss 404 is formed in the side of the tank 54 and likewise receives a metal female threaded insert to threadably engage the bolt 368. Another boss, not shown in the drawing, is formed in the side of the tank 54 with a female threaded insert to receive the bolt 370.

Figure 19:
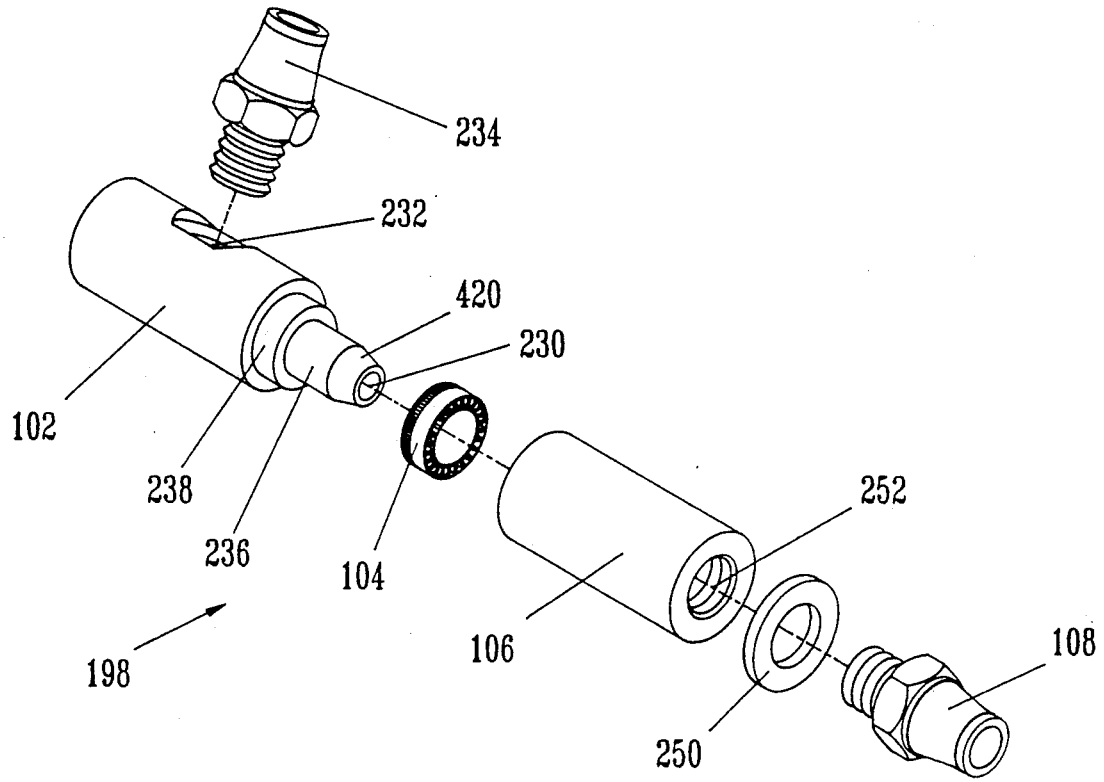
FIG. 19 is an enlarged, exploded perspective view of the swivel assembly shown in FIG. 10.

FIG. 19 is an exploded perspective view of the swivel assembly 198. An inlet port 232 is bored in the side of the male swivel body 102 to receive the fitting 234. A bore 230 is formed along the interior longitudinal axis of the male swivel body 102 and is in fluid communication with the fitting 234. A axle 236 protrudes from one end of the male swivel body 102 and an enlarged shoulder 238 abuts against the axle 236. The tip 420 of the axle 236 is tapered to facilitate assembly and rotation. A seal 104 fits over the axle 236. The female swivel body 106 has an interior bore 240 which is sized and dimensioned to fit over the axle 236, and an enlarged diameter 243 which is sized to fit over the shoulder 238, enabling rotation of the female swivel body 102 and hose spool 42. An outlet port 252 is formed in the end of the female swivel body 106 and receives the fitting 108.

Those skilled in the art will recognize that the various types of seals 104 are suitable for this application. Applicant believes that a TEFLON ®, which is E.I. DuPont de Nemours and Company's trademark name for tetrafluoroethylene, rotary seal, part no. 115HB-206, obtainable from Bal Seal Engineering Company, Inc., located in Santa Ana, California, is particularly well suited for this purpose. The outside diameter of this particular seal is 0.750 inches and the inside diameter is 0.500 inches. The aforementioned seal is formed from TEFLON and contains two interior springs. The first spring 422 exerts pressure towards the outside diameter of the seal, thus holding it in place inside the seal cavity 244. The second spring 424 exerts pressure towards the outside diameter and the inside diameter of the seal to prevent loss of fluid. The second spring 424 creates a U-shaped cup 425 which allows fluid pressure to be exerted against the exterior lip 426 and the interior lip 427, thus helping to form a fluid-tight seal between the male swivel body 102 and the female swivel body 106. Applicant has also found that it is suitable to manufacture the male swivel body 102 and the female swivel body 106 from Delrin thermoplastic. Those skilled in the art will recognize that other substances may also be suitable for manufacture of the swivel bodies.

Figure 20:
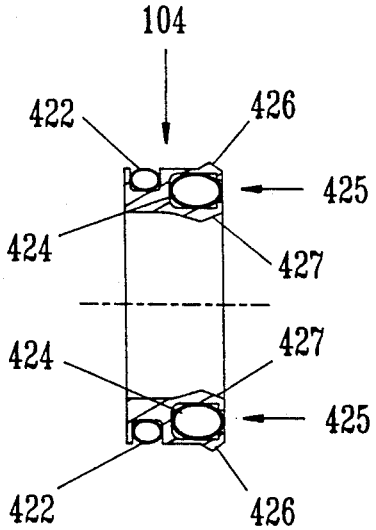
FIG. 20 is a section view of the seal 104 shown in perspective in FIG. 19.

FIG. 20 is a partial section view of the recess 72 showing how the pump 70 mounts to the tank 54. It should be noted that the bottom of the recess 72 is sloped on an angle of one to three degrees towards left sidewall 4 which facilitates drainage of any liquid which might enter the recess 72. A first boss 450 is formed in the tank 54. A second boss 452 is likewise formed in the tank 54. A third and fourth boss, not shown in this drawing, are also formed underneath the recess 72 in the tank 54. The first boss 450 threadably receives screw 122 and the second boss 452 threadably receives the screw 124. The other screws, 118 and 120, likewise threadably engage the other bosses not shown in this drawing. A anti-vibration washer 354 insulates the tank 54 from the mounting bracket 356 of the pump 70. Another anti-vibration washer 358 separates the screw 124 from the mounting bracket 356. The washers, 354 and 358, are designed to dampen any vibration caused by the pump 70. Those skilled in the art will recognize that other means may be used for dampening vibrations of the pump 70 and/or attaching the pump 70 to the tank 54.

Another boss 190 is likewise formed in the wall of the tank 54 to receive the inlet fitting 184. The integral inlet fitting 184 includes a barbed portion 181, a threaded portion 185, a hex portion 187 and an elongated portion 189. The agitator fitting 192, not shown in the drawing, is of similar integral construction.

Figure 21:
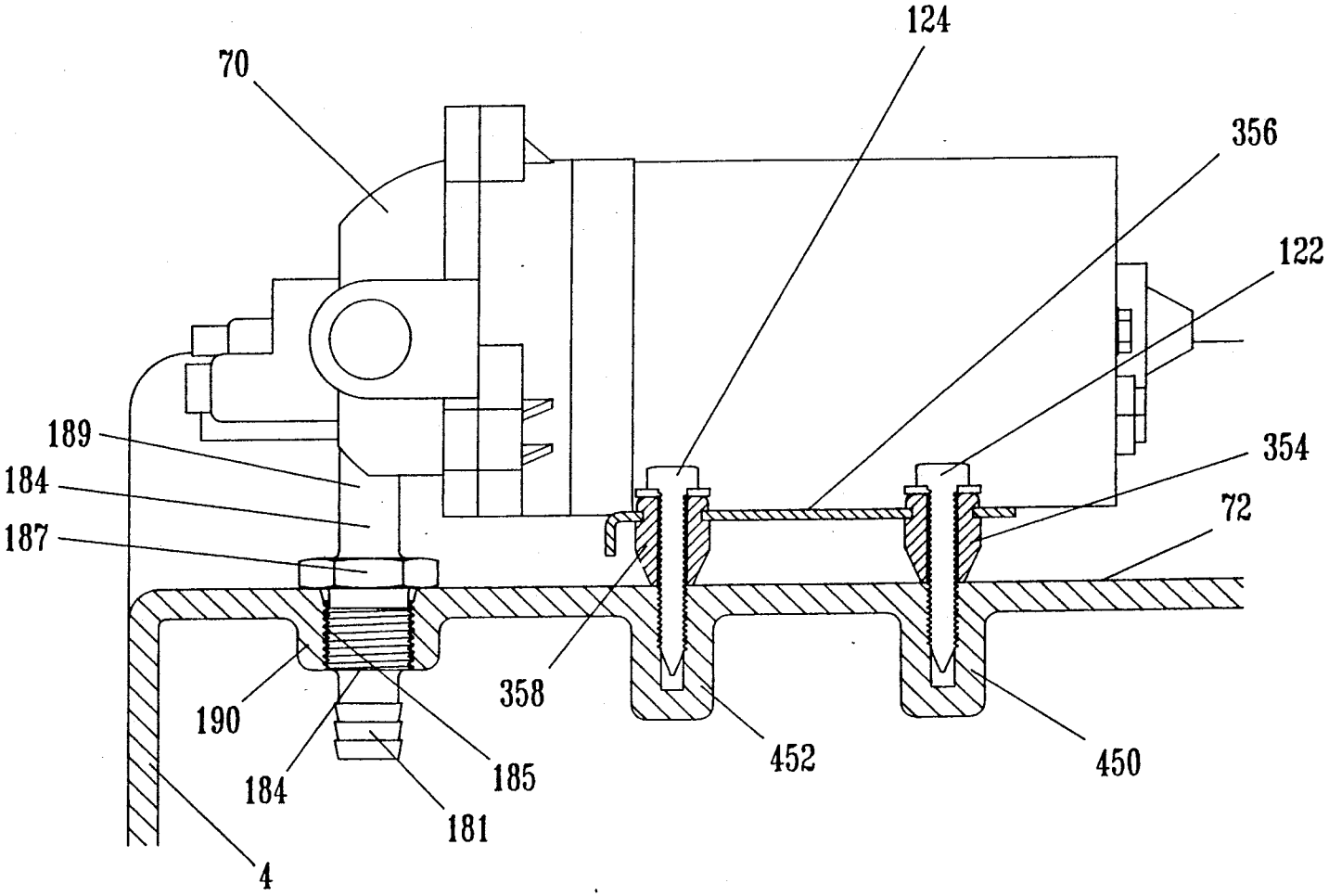
FIG. 21 is a partial section view of the tank with the pump mounted thereon.

FIG. 21 is a top plan view of an alternative embodiment the integrated modular spraying system suitable for applying dry flowables. The alternative embodiment of the integrated modular spraying system 2 includes an air pump 500 which is powered by a twelve volt D.C. electric motor. The air pump for a twelve gallon tank should have an output in the range of 0.5 to 2.0 cubic feet per minute. Those skilled in the art will recognize that many different pumps are suitable for this application. A first wire 502 and a second wire 504 are connected to the electrical system of the vehicle to power the air pump 500. This alternative embodiment does not include an agitation hose or a recirculation feature like the liquid pump. Most of the other structural members are the same. For example, a tank cap 68 fits on top of the fillwell 66. The hose spool 42 fits in a well 84 and is supported by a first buttress 88 and a second buttress 90. The hose spool 42 includes a first rim 210 and a second rim 212. A hand crank assembly 44 enables the operator 26 to rewind the hose 28 after the job has been completed. Automatic rewind devices may be substituted in this embodiment and the prior embodiment for the hand crank assembly 44 to rewind the hose about the spool 42.

The air pump 500 pumps air through the inlet line 506 which connects with an inlet hose 508, better seen in the next figure. Aerosolized dust exits the tank 54 through the fitting 510 and enters the outlet hose 536 which is connected to the swivel assembly 198 in the same fashion as for the liquid embodiment.

Figure 22:
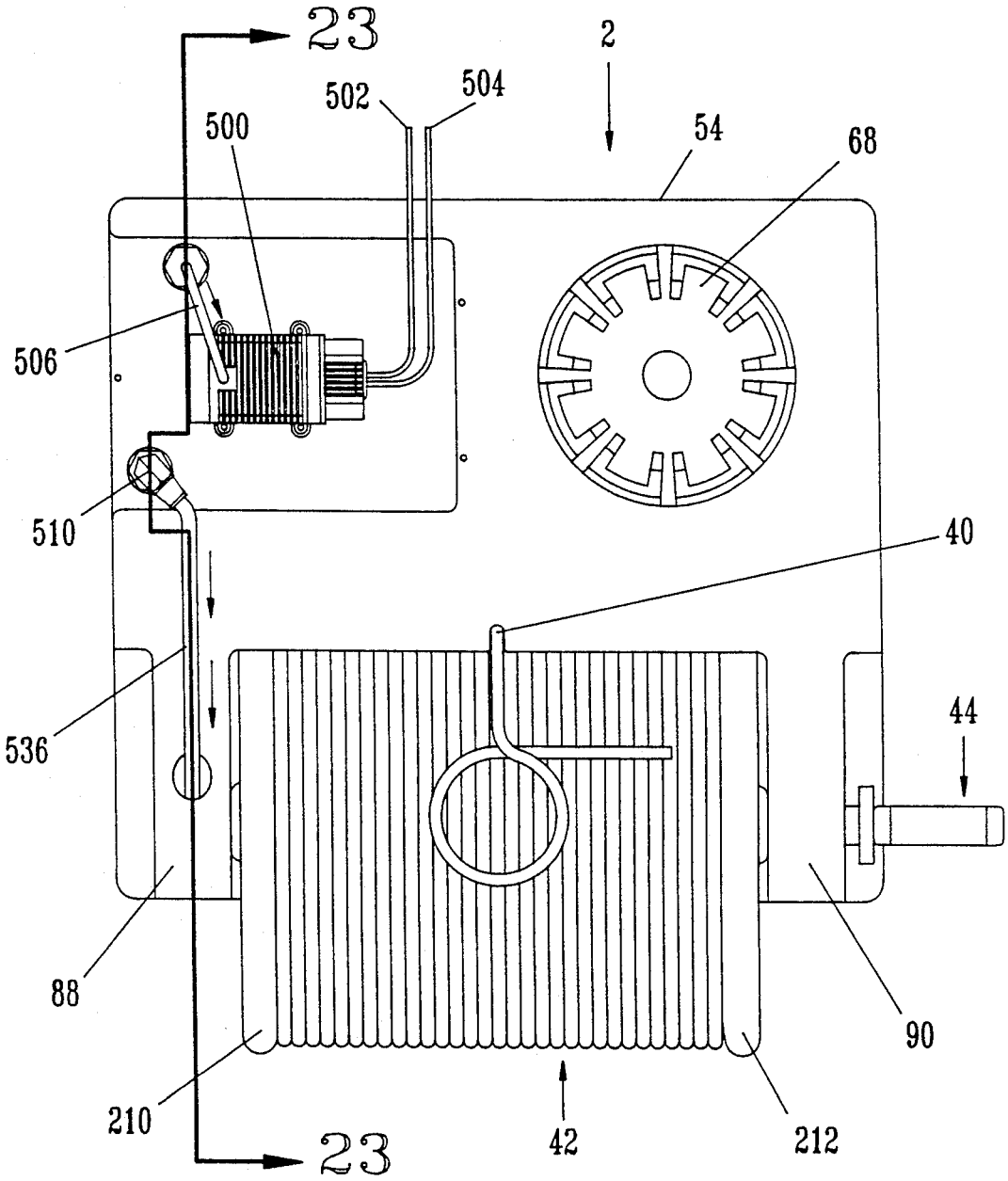
FIG. 22 is a top plan view of an alternative embodi7 ment of the integrated modular spraying system which is suitable for spraying dry flowables.
Figure 23:
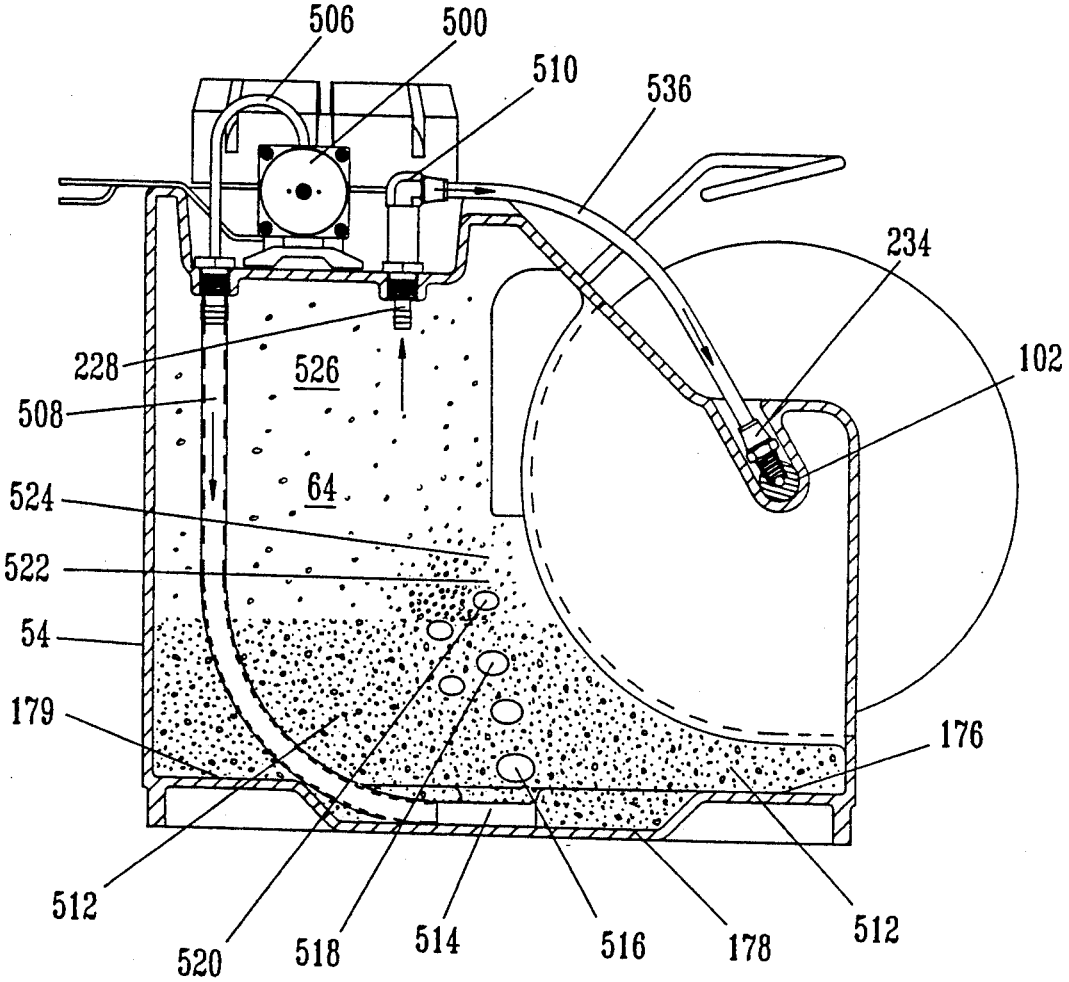
FIG. 23 is a section view of the tank along the line 23—23 of FIG. 22, showing how the system operates with a dry flowable.

FIG. 22 is a section view of the tank 54 along the line 22—22 of FIG. 21. A dust substrate is located along the floor 179 of the interior 64 of the tank 54. The inlet hose 508 rests in the sump 178 and includes a check valve 514 at the end thereof. Air bubbles 516, 518 and 520 pass through the dust substrate after leaving the check valve 514. When an air bubble reaches the top of the substrate 522, it implodes creating a dust cloud as shown by the particles 524. These dust particles 524 create an aerosolized strata in the upper section 526 of the interior 64 of the tank 54. These aerosolized particles exit through an outlet fitting 228 and pass through a 90° elbow 510 which is connected to the outlet hose 536. These aerosolized particles then enter the swivel assembly 198 and pass through the hose 28 in the same fashion as liquids.

While the foregoing is directed to the preferred embodiment of the present invention, other and further embodiments of the invention may be devised without departing from the basic scope thereof, and the scope thereof is determined by the claims which follow.

I claim:

1. An integrated modular delivery system to apply a chemical to a remote target comprising:

a) an elongate hose spool;

b) predetermined length of flexible hose which is removably wound about said hose spool;

c) an integral thermoplastic tank capable of holding a predetermined amount of the chemical;

d) means for transferring the chemical from said tank through said hose for application to the remote target;

e) said tank including:

i) a well formed in a wall of said tank and further defined by a pair of opposing buttresses extending outwardly from said tank, said buttresses for mounting said hose spool enabling it to freely rotate in said well;

ii) a fillwell formed in said tank, allowing the chemical to be replenished in said tank; and iii) a recess formed in a sidewall of said tank, said recess sized and dimensioned to receive and support said transfer means.

2. The apparatus of claim 1 wherein said transfer means is a liquid pump for liquid type chemicals.

3. The apparatus of claim 1 wherein said transfer means is an air pump for dry flowable type chemicals.

4. An integrated modular spraying system for spraying a liquid on a remote target comprising:

a) an elongate hose spool;

b) a predetermined length of flexible hose which is removably wound about said hose spool;

c) an integral thermoplastic tank capable of holding a predetermined amount of the liquid;

d) a pump for pumping the liquid from said tank through said hose for application to the remote target;

e) said tank including:

i) a well formed in a wall of said tank and further defined by a pair of opposing buttresses extending outwardly from said tank, said buttresses for mounting said hose spool enabling it to freely rotate in said well;

ii) a fillwell formed in said tank, allowing the liquid to be replenished in said tank; and iii) a recess formed in a sidewall of said tank, said recess sized and dimensioned to receive and support said pump.

5. An integrated modular spraying system for spraying a liquid on a remote location comprising:

a) an elongate hose spool capable of holding a predetermined length of a flexible hose;

b) an integral thermoplastic tank capable of holding a predetermined amount of the liquid;

c) a pump for pumping the liquid from said tank for application to the remote location;

d) said tank including:

i) a well formed in a wall of said tank and further defined by a pair of opposing buttresses extending outwardly from said tank, said buttresses for mounting said hose spool enabling it to freely rotate in said well;

ii) a fillwell formed in said tank, allowing the liquid to be replenished in said tank; and iii) a recess formed in a sidewall of said tank, said recess sized and dimensioned to receive and support said pump.

6. The apparatus of claim 5 further including a predetermined length of flexible hose which is removably wound about said hose spool.

7. The apparatus of claim 5 further including means for rotating said hose spool.

8. The apparatus of claim 7 wherein said means for rotating is a manual crank.

9. The apparatus of claim 8 wherein said manual crank includes an articulated handle which can be folded into a recess in said crank when not in use.

10. The apparatus of claim 8 wherein said means for rotating is an automatic rewind device.

11. The apparatus of claim 5 further including means for agitating the liquid.

12. The apparatus of claim 11 wherein said agitating means includes:

a) said pump having a recirculate mode; and b) a predetermined length of flexible agitating hose in fluid communication with said pump, and a venturi nozzle mounted on the end of said agitating hose, said nozzle and said agitating hose positioned inside said tank and free to move about in the liquid in response to the forces generated by said venturi nozzle when said pump is in said recirculate mode.

13. The apparatus of claim 5 further including:

a) an inlet suction hose, one end connected to said pump, and the other end connected to a screened foot; and b) a sump formed in the bottom of said tank, said sump sized and dimensioned to receive said foot of said inlet suction hose.

14. The apparatus of claim 5 further including a tank cap for said fillwell.

15. The apparatus of claim 14 further including:

a) means to attach said tank cap to said fillwell to prevent entry into said tank; and b) a removable locking plug mounted in said cap to control access to said tank.

16. The apparatus of claim 14 further including:

a) a removable cover sized and dimensioned to fit over said pump and said recess to shelter said pump; and b) means to removably attach said cover to said tank.

17. The apparatus of claim 5 further including:

a stationary elongate male swivel body positioned in one of said buttresses, said male body having a central bore aligned along the longitudinal axis of said male body;

b) an elongate female swivel body with a central bore therein rigidly attached to said hose spool, said female central bore sized and dimensioned to receive a portion of said male body and to freely rotate about said longitudinal axis of said stationary male body;

c) a seal positioned between said male body and said female body to create a fluid-tight seal between said bodies;

d) said hose on said hose spool connected to and in fluid communication with said female body; and e) an output hose connected to and in fluid communication with said pump allowing the liquid to be pumped from said tank through said output hose, through said male body, through said female body and through said hose on said hose spool for spraying on the remote target.

18. The apparatus of claim 5 further including a pigtail ring assembly rigidly attached to said tank and positioned above said hose spool to facilitate 360 degree discharge of said hose from said hose spool.

19. The apparatus of claim 5 wherein said tank includes an integral mounting frame around a bottom of said tank to facilitate attachment to a base, said frame formed and arranged to minimize the possibility that attaching screws will penetrate said tank and cause a leak.

20. The apparatus of claim 5 further including a separate mounting bracket to engage a bottom of said tank to facilitate attachment to a base, said mounting bracket formed and arranged to minimize the possibility that attaching screws will penetrate said tank and cause a leak.

21. The apparatus of claim 5 wherein said tank has a footprint that does not exceed 2'×2'.

22. The apparatus of claim 20 wherein said spraying system is sized and dimensioned to fit within a 2'×2'×2' cube.

23. The apparatus of claim 5 further including a spray wand having a manual on/off control valve and removable spray tips, said wand connected to and in fluid communication with said hose to permit an operator to spray the liquid stored in said tank on the remote target.

24. An integrated modular spraying system for spraying a liquid on a remote target comprising:

a) an elongate hose spool:

b) a predetermined length of flexible hose which is removably wound about said hose spool;

c) an integral thermoplastic tank capable of holding a predetermined amount of the liquid, said tank being in fluid communication with said pump, said tank including:

i) a well formed in a wall of said tank and further defined by a pair of opposing buttresses extending outwardly from said tank, said buttresses for mounting said hose spool enabling it to freely rotate in said well;

ii) a fillwell formed in said tank, allowing the liquid to be replenished in said tank; and iii) a recess formed in a sidewall of said tank, said recess sized and dimensioned to receive said pump;

d) a pump for pumping the liquid from said tank through said hose for application to the remote target, said pump having an on-mode, an off-mode and a recirculate mode;

e) a manual crank for rotating said hose spool, said crank including an articulated handle which can be folded into a recess in said crank when not in use;

f) means for agitating the liquid including a predetermined length of flexible agitating hose in fluid communication with said pump, and a venturi nozzle mounted on the end of said agitating hose, said nozzle and said agitating hose positioned inside said tank and free to move about in the liquid in response to the forces generated by said venturi nozzle when said pump is in said recirculate mode;

g) a tank cap for said fillwell;

h) a removable cover sized and dimensioned to fit over said pump and said recess to shelter said pump;

i) means to removably attach said cover to said tank;

j) a stationary elongate male swivel body positioned in one of said buttresses, said male body having a central bore aligned along the longitudinal axis of said male body;

k) an elongate female swivel body rigidly attached to said hose spool, said female swivel body sized and dimensioned to receive said male body and to freely rotate about said longitudinal axis of said stationary male body;

l) a rotary washer positioned between said male body and said female body to create a fluid-tight seal between said bodies;

m) said hose on said hose spool connected to and in fluid communication with said female body;

n) an output hose connected to and in fluid communication with said pump allowing the fluid to be pumped from said tank through said output hose, through said male body, through said female body and through said hose for spraying on the remote target; and o) a spray wand having a manual on/off control valve and removable spray tips, said wand connected to and in fluid communication with said hose to permit an operator to selectively spray the liquid stored in said tank on the remote target.

25. An integrated modular spraying system to apply a dry flowable on a remote target comprising:

a) an elongate hose spool;

b) a predetermined length of flexible hose which is removably wound about said hose spool;

c) an integral thermoplastic tank capable of holding a predetermined amount of the dry flowable;

d) an air pump having at least an on-mode and an off-mode to deliver the dry flowable from said tank through said hose to the remote target; and e) said tank including:

i) a well formed in a wall of said tank and further defined by a pair of opposing buttresses extending outwardly from said tank, said buttresses for mounting said hose spool enabling it to freely rotate in said well;

ii) a fillwell formed in said tank, allowing the dry flowable to be replenished, in said tank; and iii) a recess formed in a sidewall of said tank, said recess sized and dimensioned to receive and support said pump.

26. An integrated modular spraying system to apply a dry flowable to a remote location comprising:

a) an elongate flexible hose spool capable of holding a predetermined length of flexible hose;

b) an integral thermoplastic tank capable of holding a predetermined amount of the dry flowable;

c) an air pump having at least an on-mode and an off-mode to deliver the dry flowable from said tank to the remote location; and d) said tank including:

i) a well formed in a wall of said tank and further defined by a pair of opposing buttresses extending outwardly from said tank, said buttresses for mounting said hose spool enabling it to freely rotate in said well;

ii) a fillwell formed in said tank, allowing the dry flowable to be replenished in said tank; and iii) a recess formed in a sidewall of said tank, said recess sized and dimensioned to receive and support said pump.

27. The apparatus of claim 26 further including a predetermined length of flexible hose which is removably wound about said hose spool.

28. A hose reel assembly for storing a predetermined length of hose comprising:

a) a hose reel with a central axis;

b) first mounting means for said hose reel disposed at a first end of said central axis;

c) second mounting means for said hose reel disposed at a second end of said central axis, said first mounting means cooperating with said second mounting means to allow said hose reel to rotate about said central axis;

d) said second mounting means including:

i) a stationary elongate male swivel body having a central bore aligned along the longitudinal axis of said male body;

ii) an elongate female swivel body with a central bore aligned along the longitudinal axis of said female body, said female bore sized and dimensioned to receive a portion of said male body and to freely rotate about said longitudinal axis of said stationary male body, said male body and said female body together defining a load bearing axis for said hose reel; and iii) a seal positioned between said male body and said female body to create a fluid-tight seal between said bodies.

29. In a hose reel assembly having a hose reel with a central axis, and first and second spaced apart mounting mean to allow the hose reel to rotate about the central axis, a swivel coupling depending from one of said mounting means, the swivel coupling comprising:

a) a stationary elongate male swivel body having a central bore aligned along the longitudinal axis of said male body;

b) an elongate female swivel body having a central bore aligned along the longitudinal axis of said female body, said female body central bore sized and configured to longitudinally receive a portion of said male body and be removably coupled thereto, said male body constituting a bearing surface for said female body, said female body central bore being in fluid communication and coaxial with said male body central bore when said female body is coupled to said male body while said female body is at the same time freely rotatable about the longitudinal axis of said male body;

c) a seal disposed between said male body and said female body to create a fluid-tight seal therebetween; and d) said male body and said female body together constituting a bearing surface for the central axis of the hose reel.

30. The hose reel assembly of claim 29, wherein said male body is longitudinally decoupleable from said female body and removable from the one said mounting means whereby the hose reel is removable from the first and second mounting means.

31. The hose reel assembly of claim 29, wherein:

a) said male body includes a radially inwardly formed shoulder with an axially extending concentric projection along the axis of said male body, said seal radially located on said projection adjacent said shoulder; and b) said female body central bore having a larger diameter portion sized and configured to radially extend about said shoulder.

* * * * *